US007794306B2

(12) United States Patent
Kondo et al.

(10) Patent No.: US 7,794,306 B2
(45) Date of Patent: Sep. 14, 2010

(54) SURFACE FINISHING APPARATUS AND RELATED METHOD

(75) Inventors: Tomohiro Kondo, Mishima (JP); Masahiko Iizumi, Fujisawa (JP); Masahiro Omata, Yokohama (JP); Kiyoshi Hasegawa, Yokohama (JP); Takashi Ogino, Yokohama (JP); Takafumi Watanabe, Yokohama (JP); Yoshiyuki Chida, Yokohama (JP); Yasushi Matsushita, Yokohama (JP); Kazuo Takeda, Odawara (JP)

(73) Assignee: Nissan Motor Co., Ltd., Yokohama-shi (JP)

( * ) Notice: Subject to any disclaimer, the term of this patent is extended or adjusted under 35 U.S.C. 154(b) by 527 days.

(21) Appl. No.: 10/772,429

(22) Filed: Feb. 6, 2004

(65) Prior Publication Data

US 2004/0166776 A1 Aug. 26, 2004

(30) Foreign Application Priority Data

Feb. 12, 2003 (JP) ..... 2003-034073
Feb. 14, 2003 (JP) ..... 2003-036700
Feb. 14, 2003 (JP) ..... 2003-036704
Mar. 12, 2003 (JP) ..... 2003-066592

(51) Int. Cl.
*B24B 1/30* (2006.01)

(52) U.S. Cl. ..... 451/49; 81/168; 81/303

(58) Field of Classification Search ..... 451/49, 451/311, 302–307, 168
See application file for complete search history.

(56) References Cited

U.S. PATENT DOCUMENTS 4,682,444 A 7/1987 Judge et al.
5,437,125 A * 8/1995 Barton, II ..... 451/304
5,531,631 A 7/1996 Judge
5,722,878 A * 3/1998 Phillips ..... 451/49
5,730,647 A 3/1998 Becker et al.
5,865,669 A * 2/1999 Kiriyama et al. ..... 451/168
5,951,377 A * 9/1999 Vaughn et al. ..... 451/49

FOREIGN PATENT DOCUMENTS

EP 0 219 301 A2 4/1987
EP 0 802 017 A1 10/1997
EP 0 997 229 A1 5/2000
EP 1 027 956 A2 8/2000
JP 05-009225 B2 2/1993
JP 6-190718 A 7/1994
JP 7-237116 A 9/1995
JP 10-217090 A 8/1998

* cited by examiner

*Primary Examiner*—Hadi Shakeri
(74) *Attorney, Agent, or Firm*—Foley & Lardner LLP

(57) ABSTRACT

An apparatus and method for surface finishing a workpiece is disclosed as including a workpiece supporting mechanism supporting a workpiece having a target shaped periphery with a given width to be surface finished and a tool holder holding a surface finish tool in abutting contact with the target shaped periphery of the workpiece. A pressure applying mechanism is operative to apply a pressure force to the surface finish tool through the tool holder to cause the surface finish tool to be held in pressured contact with the target shaped periphery, with the pressure force exhibiting a given distribution pattern depending upon an axial direction of the workpiece. A drive mechanism rotates the workpiece to allow the surface finish tool to surface finish the target shaped periphery into a given geometrical profile, variably contoured along an axis of the workpiece depending on the given pressure distribution pattern.

19 Claims, 25 Drawing Sheets

SURFACE FINISHING APPARATUS AND RELATED METHOD

BACKGROUND OF THE INVENTION

The present invention relates to a surface finishing apparatus and a related method and, more particularly, to a surface finishing apparatus and a related method for surface finishing a workpiece in a desired geometrical profile contoured along an axial direction of the workpiece.

In the past, various attempts have been undertaken to lap a target shaped periphery, such as a journal portion or a pin portion, of a crankshaft of an automotive engine and subsequently to roller burnish the resulting surface in a desired surface roughness.

The preceding lapping operation in such surface finishing is achieved by permitting the target shaped periphery of the workpiece to be covered with a lapping film and placing a plurality of shoes on a rear side of the lapping film whereupon, under a condition where the lapping film is held in pressured contact with the workpiece, the workpiece is rotated to allow an abrasive surface of the lapping film to lap the target shaped periphery of the workpiece. To this end, a lapping apparatus includes an urging mechanism that urges shoes against the workpiece through the lapping film, a drive unit to drivingly rotate the workpiecce, and an oscillating mechanism arranged to apply an oscillating force to at least one of the workpiece and the lapping film along an axial direction of the workpiece, as disclosed in Japanese Patent Application Laid-Open Publication No. H07-237116, with reference to FIGS. 1 and 2, and their corresponding descriptions.

However, since such mere lapping operation results in an outer circumferential periphery with an insufficient profile or in an undesired surface roughness, an attempt has been made to allow a burnishing roller to be brought into pressured contact with the outer circumferential periphery of the workpiece to collapse uneven surface portions of the outer circumferential periphery of the workpiece to provide an improved surface nature in the workpiece while permitting the outer circumferential periphery of the workpiece to be formed in a mid-concave profile for use as an oil sump to enable lubricating oil to be suitably supplied as disclosed in Japanese Patent Application Laid-Open Publication No. H06-190718, with reference to FIG. 11 and its corresponding description.

In the meantime, there is a probability where one type of workpiece needs to be surface finished in a highly accurate straightness, and the other type of workpiece is intended to have a geometric geometrical profile, positively formed in mid-convex or mid-concave shapes.

Also, depending on circumstances, for the purpose of improving a surface quality of the workpiece, a probability exists where the workpiece resulting from grinding operation is directly roller burnished without lapping the workpiece

SUMMARY OF THE INVENTION

However, the lapping apparatus of the related art is arranged to achieve lapping operation under a fixed lapping condition, involving a shoe pressure force to be applied during lapping operation, and in actual practice, the use of such mere fixed lapping condition results in an inability of controlling lapping operation so as to obtain a desired geometrical profile.

Further, the roller burnishing operation of the related art encounters an issue in that it is troublesome to achieve and a roller burnishing tool per se is expensive.

In particular, when roller burnishing the pin portion of the crankshaft into a geometrical profile, having a mid-concave shape, shaft ends of the workpiece should be supported between a headstock and a tail stock to allow a pair of support rollers to be brought into abutting engagement with the target shaped periphery of the workpiece in a direction perpendicular to the axial direction of the workpiece while keeping the burnishing roller to be held in pressured contact with the target shaped periphery of the workpiece.

Since such a burnishing roller serves to transfer an outer profile of the burnishing roller to the pin portion of the crankshaft, the specific relationship should be present between individual workpieces and the associated burnishing rollers. Therefore, in order to carry out the above-described roller burnishing, there is a need for preparing burnish rollers with centrally ridged profiles in compliance with the mid-concave shapes of the individual workpieces. For this reason, it is hard to provide generalized burnishing rollers and it is hard to manufacture such generalized burnishing rollers, resulting in increased cost.

Further, although the pin portion of the crankshaft has both ends formed with fillet portions for permitting the surface finishing tool to escape, roller burnishing proximities of the fillet portions cause distal ends of the fillet portions to be collapsed to form sags that protrude into the fillet portions, resulting in a difficulty in finishing the pin portion in a desired straightness.

For this reason, the pressure force, produced by a hydraulic cylinder, to be applied to the proximities of the fillet portions and a central portion of the pin portion of the workpiece should be precisely controlled at different levels or the burnishing roller per se should have a particular hardness distribution pattern such that a hardness of the burnishing roller to be held in contact with the fillet portions is different from that of a central area of the burnishing roller.

However, adjusting the pressure force to be applied to the burnishing roller needs to perform troublesome control operation, resulting in occurrence of fear in a drop in productivity of the workpieces. Also, if the burnishing roller per se is formed to have the different hardness distribution pattern varying along a length of the burnishing roller, it is troublesome to form the burnishing roller, resulting in high cost.

Additionally, when in roller burnishing, since the burnishing roller is held in pressured contact with a whole axial surface of the crankshaft to improve the surface roughness, the whole axially extending surface of the crankshaft is entirely formed in too excellent surface finish. The presence of excessively small unevenness in the surface roughness of the pin portion of the crankshaft results in no formation of unevenness to form the oil sump in the sliding surface of the pin portion of the crankshaft. This causes deterioration in a retaining capacity of lubricating oil and depending on circumstances, there is a fear of occurrence of shortage in oil film, seizure and biting.

Therefore, the present invention has been completed upon such careful studies conducted by the present inventors and has an object to provide a surface finishing apparatus and its related method which allow a workpiece to be surface finished into a given geometrical profile through adjustment of surface finishing conditions.

To achieve the above object, in one aspect according to the present invention, a surface finishing apparatus, for surface finishing a workpiece, comprises: a workpiece supporting mechanism supporting a workpiece having a target shaped periphery to be surface finished; a surface finish tool adapted to be in abutting contact with the target shaped periphery of the workpiece; a pressure applying mechanism operative to apply a pressure force to the surface finish tool to cause the surface finish tool to be held in pressured contact with the target shaped periphery of the workpiece, with the pressure force exhibiting a distribution pattern depending upon an axial direction of the workpiece; and a drive mechanism rotating the workpiece about the axial direction during operation of the pressure applying mechanism to allow the surface finish tool to surface finish the target shaped periphery of the workpiece into a given geometrical profile, while exhibiting the distribution pattern of the pressure force of the surface finish tool.

Stated another way, in another aspect according to the present invention, a surface finishing apparatus, for surface finishing a workpiece, comprises: workpiece supporting means for supporting a workpiece having a target shaped periphery to be surface finished; a surface finish tool adapted to be in abutting contact with the target shaped periphery of the workpiece; pressure applying means for applying a pressure force to the surface finish tool to cause the surface finish tool to be held in pressured contact with the target shaped periphery of the workpiece, with the pressure force exhibiting a distribution pattern depending upon an axial direction of the workpiece; and rotating means for rotating the workpiece about the axial direction during operation of the pressure applying means to allow the surface finish tool to surface finish the target shaped periphery of the workpiece into a given geometrical profile, while exhibiting the distribution pattern of the pressure force of the surface finish tool.

In the meanwhile, in another aspect according to the present invention, a method of surface finishing a workpiece comprises: supporting a workpiece having a target shaped periphery to be surface finished; holding a surface finish tool in abutting contact with the target shaped periphery of the workpiece; applying a pressure force to the surface finish tool to cause the surface finish tool to be held in pressured contact with the target shaped periphery of the workpiece, with the pressure force exhibiting a distribution pattern depending upon an axial direction of the workpiece; and rotating the workpiece about the axial direction to allow the surface finish tool to surface finish the target shaped periphery of the workpiece into a given geometrical profile, while exhibiting the distribution pattern of the pressure force of the surface finish tool.

Other and further features, advantages, and benefits of the present invention will become more apparent from the following description taken in conjunction with the following drawings.

DETAILED DESCRIPTION OF THE PREFERRED EMBODIMENTS

Hereunder, a surface finishing apparatus and its related method of each of various embodiments according to the present invention are described below in detail with reference to the accompanying drawings. In the following description, directional terms, such as "laterally", "horizontally" and "vertically", are used for convenience in referring to the accompanying drawings. Additionally, it is to be understood that the various embodiments of the present invention described herein may be utilized in various orientations, such as inclined, inverted, horizontal, vertical, etc., without departing from the principles of the present invention. Also, for the sake of convenience of explanation, an axial direction (a lateral direction, for example, as viewed in FIG. 1) of a workpiece is assigned to be an X-direction, a lateral or horizontal direction (perpendicular to a page space, for example, in FIG. 1) perpendicular to the X-direction a Y-direction and a vertical direction perpendicular to the X-direction a Z-direction. Also, in the following description of surface finishing apparatuses and related methods of various embodiments of the present invention, by the term "surface finishing" is meant the surface processing including lapping or roller burnishing.

First Embodiment

Figure 1:
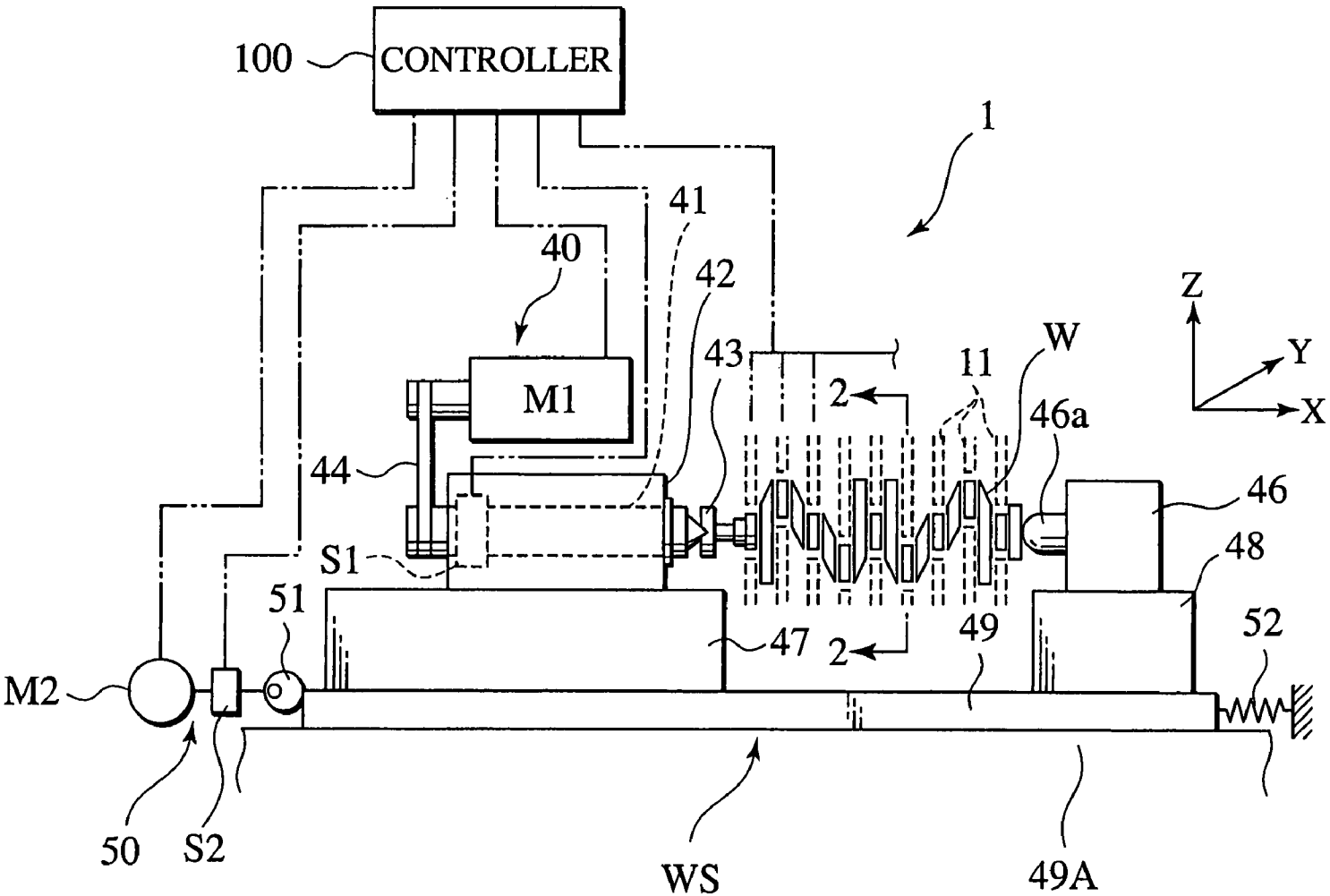
FIG. 1 is a schematic front view of a surface finishing apparatus, in the form of a lapping apparatus, of a first embodiment according to the present invention.
Figure 2:
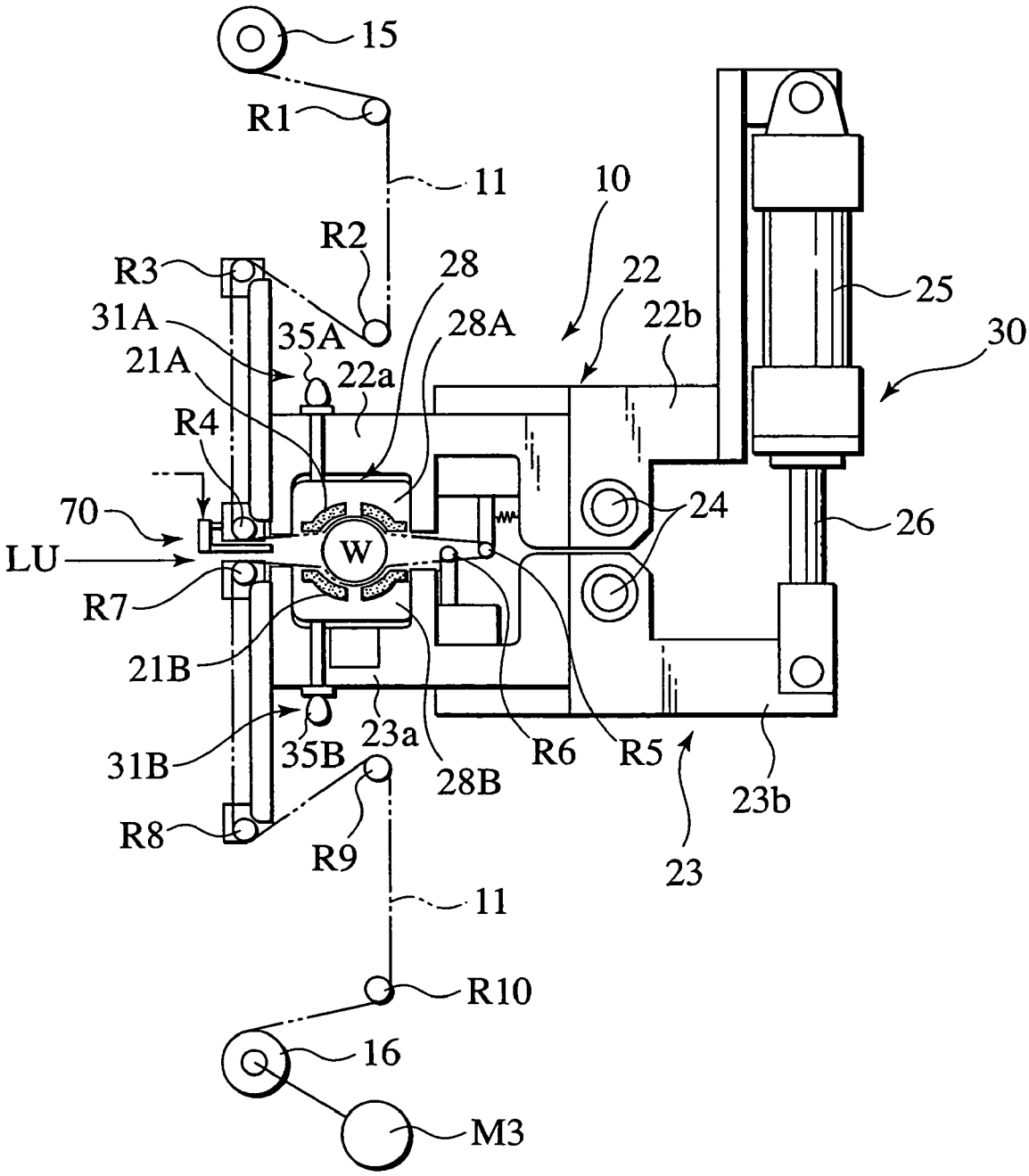
FIG. 2 is a schematic view corresponding to a cross section taken on line 2-2 of FIG. 1, in the first embodiment.

Referring now to FIGS. 1 and 2, there is shown a surface finishing apparatus, in the form of a lapping apparatus 1, of a first embodiment of the present invention. FIG. 1 is a schematic front view of the lapping apparatus, and FIG. 2 is a schematic view corresponding to a cross section taken on line 2-2 of FIG. 1.

As shown in FIGS. 1 and 2, the lapping apparatus 1 of the presently filed embodiment serves to finely lap a workpiece W, in the form of a crankshaft, in given surface finish subsequent to preceding rough surface machining operation, such as cutting using a machining tool, heat treatment and grinding operation. That is, the lapping apparatus 1 serves to lap a target shaped periphery of the workpiece W, such as a journal portion or a pin portion of the crankshaft, in a desired surface quality with a surface profile formed in a mid-concave shape. The lapping apparatus 1 is shown to include a workpiece supporting mechanism WS that supports the workpiece W having the target shaped periphery of the workpiece W to be finely lapped in a given surface finish, a pressure applying mechanism 10 operative to apply a pressure force to a surface finish tool, in the form of a lapping film 11, such that the lapping film 11 is held in pressured contact with the target shaped periphery of the workpiece W with the pressure force exhibiting a distribution pattern depending upon an axial direction of the workpiece W, an actuator 30 associated with the pressure applying mechanism 10, a drive mechanism 40 driving the crankshaft W to allow the lapping film 11 to lap the target shaped periphery of the crankshaft into a desired geometrical profile, and a tool shifting mechanism 50, in the form of an oscillating mechanism, that laterally shifts at least one of the lapping film 11 and the workpiece W.

More particularly, in the lapping apparatus 1 of the presently filed embodiment, the workpiece supporting mechanism WS comprises a base 49A, a workpiece support table 49 disposed on the base 49A for sliding movements in the X-direction, a biasing member 52 resiliently coupled to the workpiece support table 49 to allow the same to be horizontally oscillated as described below, a first slidable table 47 disposed on the workpiece support table 49 and a second slidable table 48 disposed on the workpiece support table 49, with the first and second slidable tables 47, 48 being slidable in the Y-direction, a headstock 42 carried on the first slidable table 47 and rotatably supporting a spindle 41 by which a chuck 43 is connected to grip one end of the workpiece W, and a tailstock 46 having a center 46a to support the other end of the workpiece W.

In the lapping apparatus 1, a target shaped periphery of the workpiece W is lapped using the lapping film 11 in a manner described below. The lapping film 11 includes a thin-walled base member 11*a* (as shown FIG. 3 described later) that is non-extensible and deformable and has an entire surface covered with abrasive material with an abrasive face 11*b* (as shown FIG. 3 described later) of the thin-walled base member being placed to face the target shaped periphery of the workpiece W to be lapped. Although the lapping film 11 can be classified into various types and, in the presently filed embodiment, the thin-walled base member is formed of non-extensible material, such as polyester resin, formed in a strip-like structure with a given width and a thickness "t" (as shown FIG. 3 described later) ranging from approximately 25 μm to 150 μm. Formation of such a lapping film 11 using the thin-walled base member that is non-extensible and deformable allows the target shaped periphery of the workpiece W to be smoothly lapped in a preferable fashion.

In the lapping film 11, the thin-walled base member has a surface provided with a large number of abrasive grains, such as aluminum oxide, silicone carbide and diamond, with a grain diameter ranging from approximately several micron meters to 200 μm, with the abrasive grains (such as aluminum oxide, silicone carbide and diamond) being fixed to the thin-walled base member by adhesive. The lapping film 11 may take a structure wherein the abrasive grains are adhered to an entire surface of the thin-walled base member or a structure wherein non-abrasive regions, each with a given width, that are intermittently formed along a length of the thin-walled base member. It is a usual practice for the other surface of the thin-walled base member to be applied with a back coating layer composed of resisting material (not shown) such as rubber or plastic resin, but non-slip surface treatment may be carried out on the other surface of the thin-walled base member if desired.

As best shown in FIG. 2, the lapping film 11 is stretched between a supply reel 15 and a winding reel 16 that are rotatably supported on a frame body (not shown) of the lapping apparatus 1, and the winding reel 16 is operatively connected to and driven by a drive motor M3. Disposed between the supply reel 15 and the winding reel 16 is a tensioned guide roller R5 that is pulled in a given tensioned force. Operating the motor M3 to rotate the winding reel 16 to cause the lapping film 11 to be pulled out from the supply reel 15 and guided by a plurality of guide rollers R1 to R10 to be wound by the winding reel 16.

Disposed in the vicinity of the supply reel 15 and the winding reel 16 are lock mechanisms (not shown) which are selectively actuated to cause the lapping film 11 to be entirely applied with a given tension and to remain tensioned for lapping operation.

As best shown in FIG. 2, the pressure applying mechanism 10 is comprised of a tool holder 28 including an upper shoe case 28A, carrying therein a plurality of shoes 21A, and a lower shoe case 28B carrying therein a plurality of shoes 21B, with the shoes 21A and 21B serving as tool holding elements and disposed on a rear side of the lapping film 11 to allow the abrasive face of the lapping film 11, serving as the surface finishing tool, to be held in a pressured contact with the target shaped periphery of the workpiece W to be lapped. Each of the shoes 21A, 21B is formed of rubber or plastic material in structure with a relatively increased rigidity and has an inside portion formed in a circular arc surface to fit the target shaped periphery of the workpiece W to be lapped while an outside portion is retained by the shoe case.

In addition, the pressure applying mechanism 10 further includes an upper presser arm 22 and a lower presser arm 23 which are pivotally supported by upper and lower pivot shafts 24, 24, respectively, to allow front end portions 22*a*, 23*a* to be moved into or out of operative positions, respectively. The actuator 30 is comprised of a fluid cylinder 25 (adapted to be actuated by hydraulic pressure or air under pressure) operatively disposed between rear end portions 22*b*, 23*b* of the upper presser arm 22 and the lower presser arm 23, respectively, to selectively apply shoe pressure forces to the front end portions 22*a*, 23*a*, respectively, through a rod. 26 such that the shoes 28A, 28B are held in pressured contact with the target shaped periphery of the workpiece W to be lapped at given pressure forces.

With such a structure of the pressure applying mechanism 10, upon actuation of the fluid cylinder 25, both the presser arms 22, 23 move about the centers of the pivot shafts 24, 24 for opening and closing capabilities. Opening and closing movements of both the presser arms 22, 23 are carried out in association with the lapping film 11 and, during closing movements of both the presser arms 22, 23, the shoes 21A, 21B are brought into pressured contact with the workpiece W by means of the lapping film 11 whereas, during opening movements of both the presser arms 22, 23, the shoes 21A, 21B are brought out of abutting engagement between the workpiece W and the shoes 21A, 21B.

Moreover, the lapping apparatus 1 further includes shoe pressure force adjusting units 31A, 31B as shown in FIG. 2 by which spring forces of compression springs (not shown) to be applied to the shoe cases 28A, 28B are adjusted by cams 35A, 35B. However, the present invention is not limited to such a particular shoe pressure force adjusting structure and may take an alternative structure in which the spring forces are adjusted through the use of screw members.

During lapping operation, heat builds up in the shoe cases 28A, 28B and a cooling unit 70 is disposed on a front side of the pressure applying mechanism 10 to supply coolant to cooling areas proximate to the workpiece W and the lapping film 11 associated therewith for cooling these components.

Turning back to FIG. 1, the drive mechanism 40 includes a main drive motor M1 that is connected to and drive the spindle 41 through a belt 44 to rotate the workpiece W for lapping operation.

With the structure set forth above, the workpiece W is set between the headstock 42 and the tailstock 46. Then, the main motor M1 is operated and the workpiece W is rotated through the spindle 41 and the chuck 43 for lapping operation. Operatively coupled to the spindle 41 is a rotary encoder S1 that detects a rotary position of the workpiece W during lapping operation and delivers a detection signal, indicative of the rotary position of the workpiece W, to a controller 100. The controller 100 is responsive to this detection signal to allow a rotational speed of the main motor M1 to be varied to enable the workpiece W to be driven at a workpiece rotational speed Vw of a given value.

Moreover, the oscillating mechanism 50, serving as the tool shifting mechanism, oscillates the workpiece W along a horizontal axis thereof for a specific reason as will be described below in detail. To this end, the oscillating mechanism 50 is comprised of an eccentric rotary element 51 rotatably supported by the frame body in abutting engagement with a distal end of the workpiece support table 27, a motor M2 connected to and drive the eccentric rotary element 51 for oscillating the workpiece support table 49 and the urging unit 52 that urges the workpiece support table 49 in the lateral direction to cause the eccentric rotary element 51 into abutting engagement with the distal end of the workpiece support table 49. Cooperation between rotation of the eccentric rotary element 51, caused by the motor M2, and the urging unit 52 enables the workpiece support table 49 to be operated in reciprocating movements in an X-direction such that the entirety of the workpiece W is oscillated in the X-direction. Additionally, for the purpose of detecting an oscillating position of the workpiece W relative to the lapping film 11 during oscillating operation in the X-direction, a rotary encoder S2 is mounted for detecting a rotary position of the eccentric rotary element 51 to allow resulting detection signal to be delivered to the controller 100.

An oscillating stroke in which the workpiece W travels in a lateral direction is determined based on eccentric displacement of the eccentric rotary element 51 with respect to an axis of an output shaft of the motor M2. The rotary position of the eccentric rotary element 51 is detected by the rotary encoder S2, and adjustment of eccentric displacement may be executed by inserting one or more number of adjustor plates into an engaged area between the motor M2 and the eccentric rotary element 51 or by using a hydraulic unit.

Also, while the presently filed embodiment has been described above with reference to a particular example wherein the oscillating mechanism 50 oscillates the workpiece W along the X-direction, the present invention is not limited to such a particular structure. The oscillating mechanism 50 may be modified in such a way as to directly oscillate the lapping film 11 along a longitudinal direction thereof. This is achieved through the use of a structure wherein the lapping film 11 is pulled out from the shoes 21A, 21B in a radial direction once to be wound on a roller whereupon the lapping film 11 is restored to the initial position near the shoes 21A, 21B, with the roller being connected to an oscillating means to be oscillated in the radial direction.

Incidentally, as shown in FIG. 2, lubricating liquid LU such as lubricating oil is supplied toward the lapping film 11 and the shoes 21A, 21B.

Figure 3:
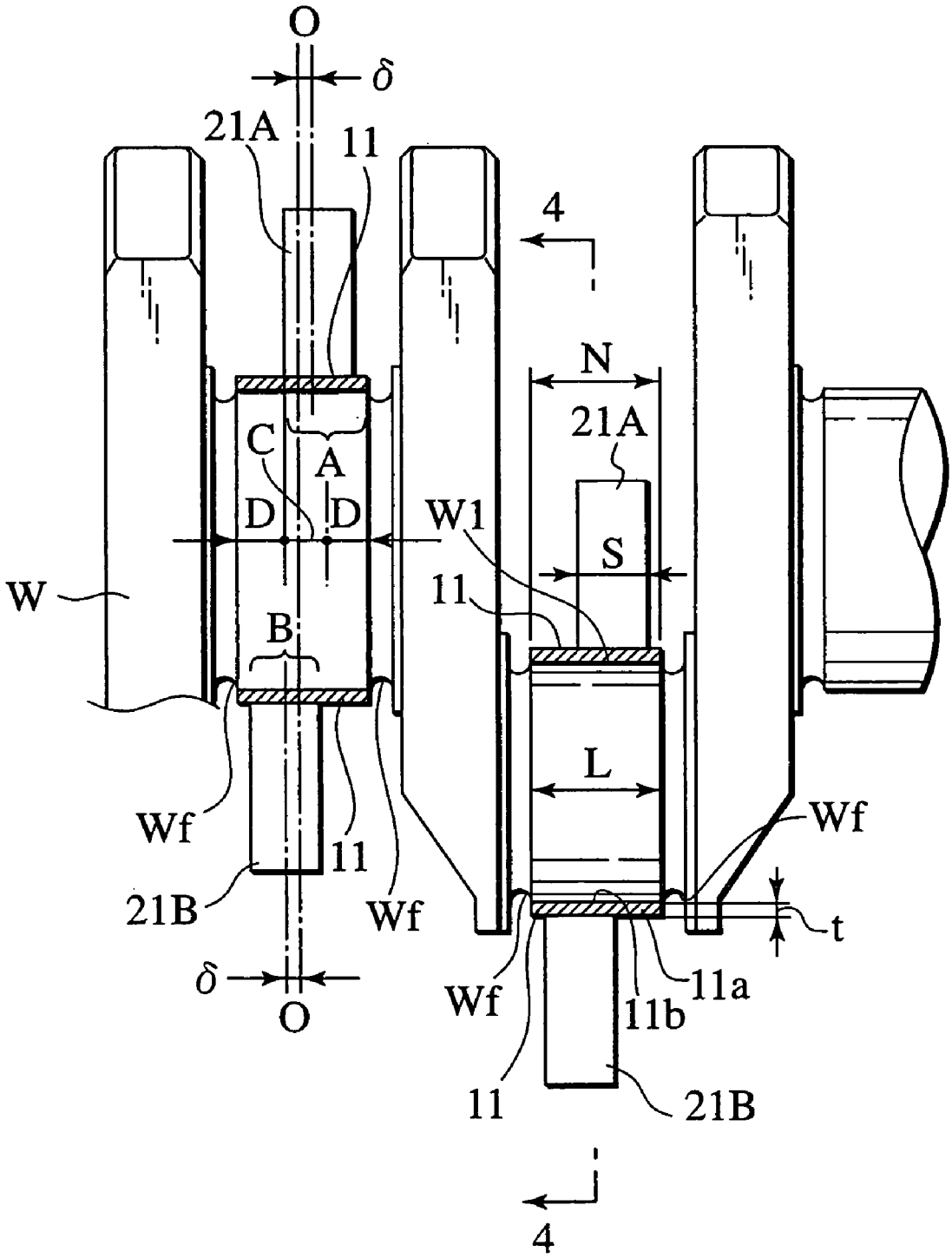
FIG. 3 is a schematic structural view illustrating an essential part of the surface finishing apparatus shown in FIG. 1, in the first embodiment.
Figure 4:
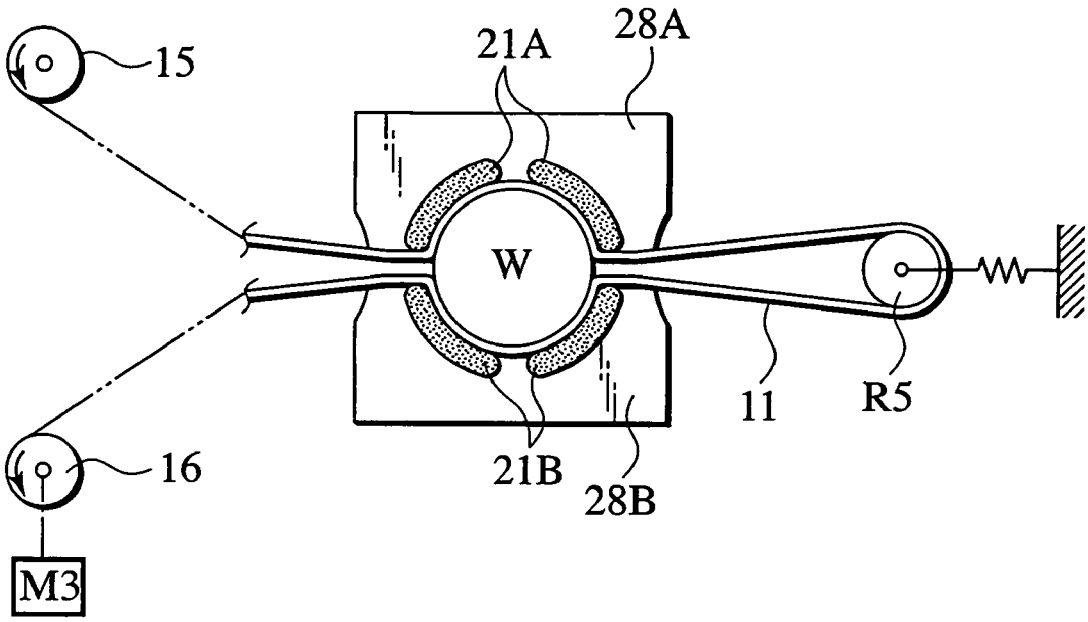
FIG. 4 is a cross sectional view taken on line 4-4 of FIG. 3, in the first embodiment.
Figure 5:
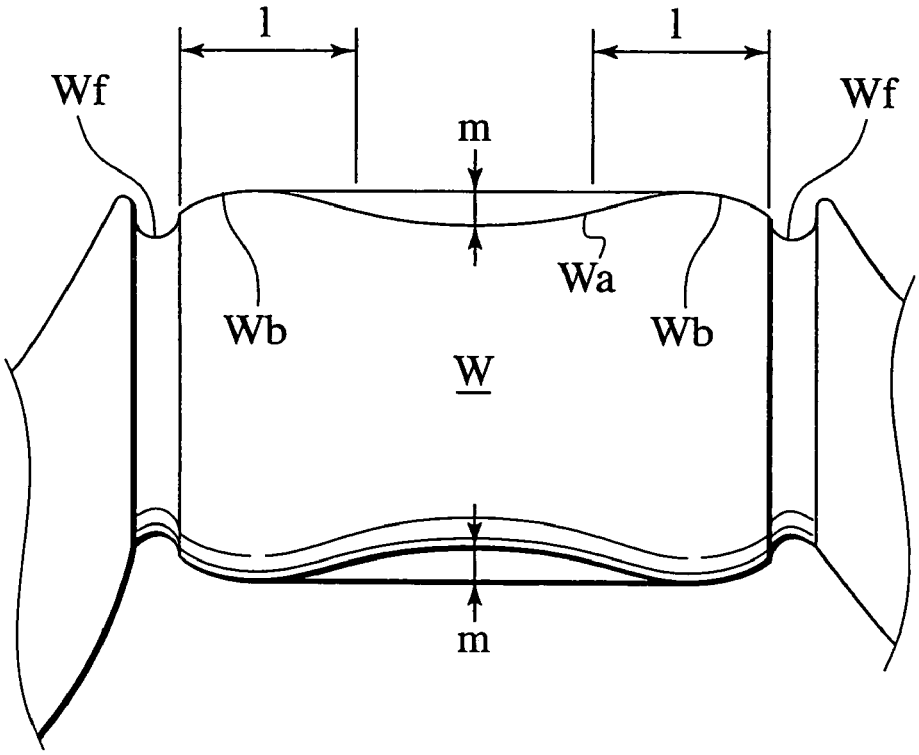
FIG. 5 is a front view illustrating a geometrical profile of a workpiece resulting from lapping operating using the surface finishing apparatus shown in FIG. 1, in the first embodiment.

FIG. 3 is a schematic structural view of an essential part of the crankshaft W for illustrating how the target shaped periphery of the crankshaft W is lapped in the lapping apparatus of the presently filed embodiment to provide a mid-concave profile on the target shaped periphery, FIG. 4 is a cross sectional representation taken along line 4-4 of FIG. 3 and FIG. 5 is an enlarged front view of a part of the crankshaft for illustrating a surface profile formed in the mid-concave shape as a result of lapping operation.

Especially, the presently filed embodiment contemplates to provide an arrangement in which the upper and lower shoes 21A, 21B are offset in contact position, in which the lapping film 11 is urged, with the target shaped periphery with respect to a center line thereof to enable the target shaped periphery of the crankshaft W to be lapped in the mid-concave profile. Here, by the term "target shaped periphery W1 of the crankshaft W" is meant the outer circular-arc shaped periphery between the fillet portions Wf.

As shown in FIGS. 3 and 4, the lapping apparatus 1 of the presently filed embodiment employs an even number of shoes 21A, 21B which are mutually offset with respect to the target shaped periphery W1 of the workpiece. With such an arrangement, the two upper shoe components are able to be held in contact with the target shaped periphery W1 at a contact region A and the two lower shoe components are held in contact with the target shaped periphery W1 at a contact region B such that the contact regions A, B overlap in a central region C lying at a center line O-O and do not overlap in terminal regions D, D closer to the fillet portions Wf, Wf. Also, hereinafter, the term "contact" refers to a phase in that the upper and lower shoes 21A, 21B are held indirect abutting contact with an outer periphery (target shaped periphery) W1 of the workpiece W through the lapping film 11, and by the term "contact region" is meant the region in which the upper and lower shoes 21A, 21B are held in indirect abutting contact with the outer periphery W1 of the workpiece W through the lapping film 11.

With such an offset arrangement of the upper and lower shoes 21A, 21B with respect to the target shaped periphery W1 of the workpiece W, the lapping film 11 is apt to be pressured against the central region C of the target shaped periphery W1 of the crankshaft W through all of the upper and lower shoes 21A, 21B to increase a lapping time interval for the target shaped periphery W1 of the crankshaft W whereas, in the terminal regions D of the target shaped periphery W1, the lapping film 11 is intermittently brought into pressured contact with the target shaped periphery W1 with the upper and lower shoes 21A, 21B, resulting in reduction in the time interval for which the workpiece W is lapped.

As a result, the target shaped periphery W1 of the crankshaft W has a surface profile having the central region C formed in a concave profile Wa and the terminal regions each formed in a convex profile Wb, resulting in formation of an entire structure with a mid-concave profile as shown in FIG. 5.

The surface profile of the workpiece W was tested to provide quantitative results in terms of offset displacement between the upper and lower shoes 21A, 21B in a manner as described below.

When conducting tests, use was made of the lapping film 11 with a width N in compliance with a width S of the target shaped periphery W1 of the workpiece W and the even number of shoes 21A, 21B formed in the same width S that was made smaller than the width S of the target shaped periphery W1 to be lapped as shown in FIG. 3. The upper and lower shoes 21A, 21B were offset by a value δ in opposite directions with respect to the center line O-O of the lapping width S of the workpiece W. Here, the offset displacement δ was expressed in a percentage (100×δ/L%) with respect to the lapping width L.

Figure 6:
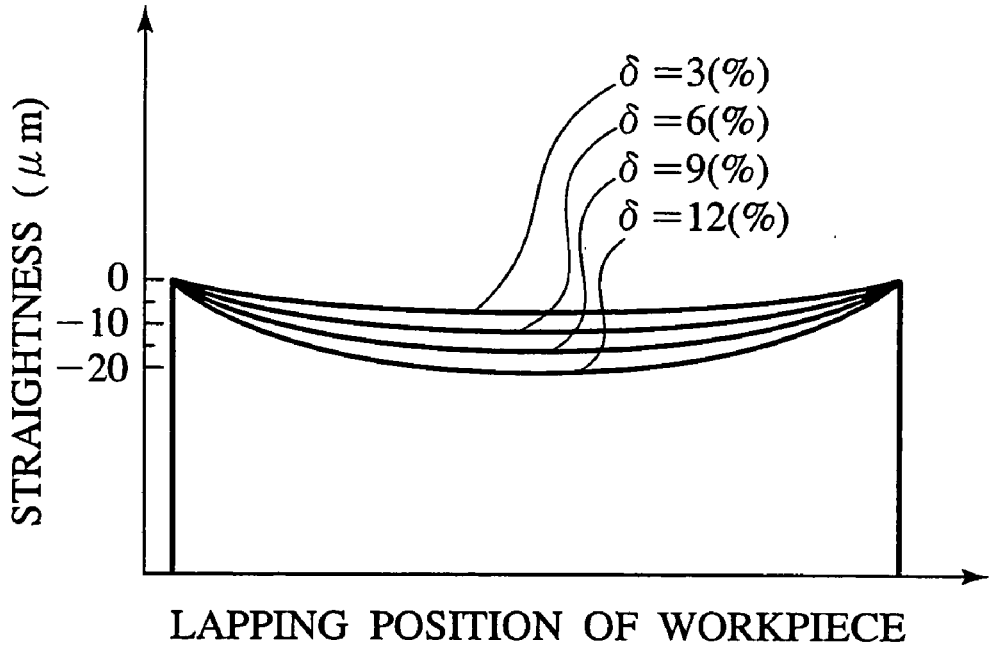
FIG. 6 is a graph illustrating the relationship between a straightness and a lapping position depending upon offset displacement of a lapping film, in the first embodiment.

Then, operations were carried out to lap the target shaped periphery W1 of the workpiece W in offset displacement at differing values of 3, 6, 9, 12%, respectively, and straightness were measured for respective surface profiles resulting from lapping operations, with measured results being shown in FIG. 6.

FIG. 6 is a view illustrating straightness of resulting surface profiles of the workpiece in terms of various offset displacements with abscissa indicating a position of the resulting surface profile of the workpiece W while the coordinate representing the straightness of the surface profiles, resulting from lapping operations, that is, in a value (μm) equivalent to a depth m of the mid-concave portion Wa.

With respect to the results shown in FIG. 6, in consideration of a result deemed to be preferable when the depth m of the mid-concave portion Wa of the workpiece W falls in a value equal to or greater than 5 μm and equal to or less than 20 μm, it appears that desired surface profiles resulting from lapping operations are obtained under a condition where the offset displacement between the associated shoes 21A, 21B lies in a value equal to or greater than 3 and equal to or less than 12%. Especially, with the arrangement described above in which the even number of the shoes 21A, 21B with the same width S are used and disposed in offset positions with respect to the center line O-O of the target shaped periphery W1 of the workpiece W, the target shaped periphery W1 of the workpiece W can be formed in the surface profile to have the mid-concave profile around the center line O-O of the target shaped periphery W1 of the workpiece W. Also, the upper and lower shoes 21A, 21B can be placed in the offset positions in an easy and precise fashion and even when concurrently carrying out the lapping operations on multiple target peripheries, the multiple target shaped peripheries of the workpiece W can be precisely lapped at the respective central regions, enabling formation of desired mid-concave portions of the target shaped peripheries of the workpiece W in a uniform profile with a resultant improved product quality.

Further, as set forth above, with the lapping apparatus 1 of the presently filed embodiment having the oscillating mechanism 50 enabling the workpiece W to oscillate in the X-direction, it is preferable for the relationship between the oscillating stroke, provided by the oscillating mechanism 50, and the offset displacement δ such that the offset displacement δ is made smaller than the oscillating stroke. However, it is preferable for the shoes 21A, 21B associated with the lapping film 11 not to be dislocated from the target shaped periphery of the workpiece W even when the shoes 21A, 21B are disposed in the offset positions with respect to the lapping film 11.

In operation, both the presser arms 22, 23 are brought into the open condition and under such a condition, the lock unit associated with the supply reel 15 is locked whereupon the motor M3 is operated to rotate the winding reel 16. This causes the lapping film 11 to be moved in a given length with a new abrasive surface of the lapping film 11 being set to face the target shaped periphery W1 of the workpiece W while applying the lapping film with a given tension.

And, when locking the lock unit associated with the winding reel 8, the lapping film 11 is applied with tension to fall in a stretched state with no looseness.

Under such a circumstance, the workpiece W is set between the headstock 42 and the tailstock 46. After such setting operation, the fluid cylinder 25 is actuated and the both presser arms 22, 23 are brought into the closed condition. When this takes place, the lapping film 11 is set onto the target shaped periphery W1 of the workpiece W, with both shoes 21A, 21B being brought into abutting engagement with the target shaped periphery W1 of the workpiece W with a given urging force. In the presently filed embodiment, the workpiece W takes the form of the crankshaft that has a plurality of pins with the target shaped peripheries, respectively, and the lapping films 11 are set onto these target shaped peripheries in pressured contact, respectively.

Then, the main motor M1 is operated and the workpiece W is rotated, causing the target shaped peripheries of the workpiece W to be lapped with the associated abrasive surfaces of the lapping films 11. Depending on shapes of the pin portions, a probability occurs in which some of the pin portions eccentrically rotate with accompanied rocking movements of both the presser arms 22, 23 in a normal practice, with resultant lapping operations being similarly executed on the associated pin portions.

In the presently filed embodiment, particularly, due to the presence of the shoes 21A, 21B disposed in the offset positions with respect to the center line O-O of the target shaped periphery W1 of the workpiece W, the contact regions A of the shoes 21A, 21B held in contact with the target shaped periphery W1 overlap one another at the central region C of the target shaped periphery W1 of the workpiece W and do not overlap one another at the terminal regions D. When this takes place, in the central region C of the target shaped periphery W1 of the workpiece W, both the shoes 21A, 21B are effective to press the lapping film 11 onto the target shaped periphery W1 of the workpiece W to allow the central region C of the target shaped periphery W1 to be lapped at a greater rate than those at which the other regions are lapped, resulting in the workpiece W having surface profiles each formed in a mid-concave profile.

Thus, when carrying out lapping operation to provide the target shaped periphery formed in the mid-concave profile, it is extremely advantageous in that the number of processing steps is decreased to a lower value than that required in using a burnishing roller and no specific roller is required in use with a resultant decrease in a cost performance. Additionally, no probability occurs in the workpiece to have a surface roughness formed in an undesirably smoothed extent and thus, an oil sump area is advantageously formed in the central region of the target shaped periphery of the workpiece to be highly advisable in a lubricating capability.

In the meantime, during lapping operation of the lapping apparatus 1, the motor M2 is operated to allow the eccentric rotary element 51 of the oscillating mechanism 50 to rotate against the biasing force of the urging unit 52, thereby oscillating the workpiece support table 49 in the X-direction to cause the workpiece W to oscillate in the X-direction.

During oscillating operation of the oscillating mechanism 50, there occurs an increase in a distance in which the target shaped periphery W1 of the workpiece W and the abrasive grains of the lapping film 11 are held in contact, resulting in an increase in the number of abrasive grains acting upon the target shaped periphery per unit time for thereby enabling lapping operation to be achieved within a shortened time interval to surface finish the workpiece at an increased efficiency. Due to the presence of the offset displacement δ between the associated shoes 21A, 21B to be made smaller than the oscillating width, the oscillation and lapping operation can be reliably performed.

Further, as shown in FIG. 3, since the workpiece W has the journal portion and the pin portion each formed with fillet portions Wf at both ends of the target shaped periphery to allow the fillet portions Wf to be used for providing spaces to enable the workpiece W to oscillate and the associated shoes to be placed in the offset positions, it becomes possible to provide an improved operability. Also, during such lapping operation, no crushing or wearing, that would otherwise occur in roller burnishing operation, occur in the vicinity of the fillet portions Wf, enabling the workpiece W to be machined at a desired straightness.

Figure 7:
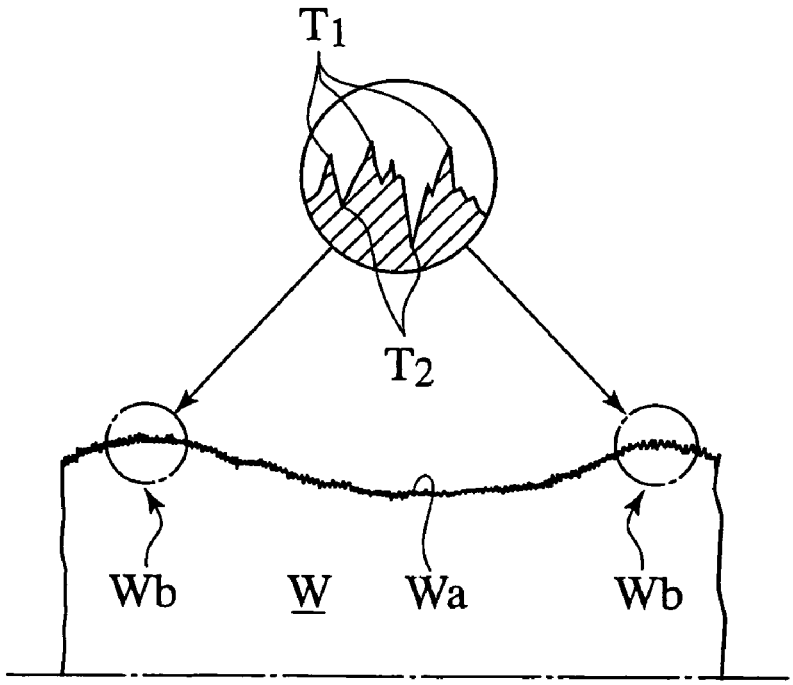
FIG. 7 is a conceptual view showing an enlarged status of a surface of the workpiece shown in FIG. 5, in the first embodiment.

FIG. 7 is a schematic view illustrating a surface, in an exaggerated form, of the target peripheries shown in FIG. 5. When performing lapping operation in a manner set forth above, the surfaces of the mid-concave portion Wa and the terminal portions Wb appear to have axially contoured configurations, as viewed in cross section, in which sharp edges $T_1$ and valley portions $T_2$ are alternately formed as shown in FIG. 7.

With such concave and convex portions being filled with lubricating oil, the concave and convex portions serve as desired oil reservoirs, exhibiting a desired function to provide am improved lubricating capability while preventing the journal or pin portions from being seized. However, in actual practice to provide a final product, it is preferable for the sharp edges $T_1$ to be subjected to burnishing operation so as to remove the sharp edges $T_1$ such that the sharp edges $T_1$ is lowered to some extent. In so doing, it becomes possible to prevent the sharp edges $T_1$, that would otherwise be caused during an initial stage of start-up of an engine from being worn, with a resultant increase in a durability.

The present invention is not limited to the presently filed embodiment set forth above, and various alterations may be made. While the presently filed embodiment has been described with reference to a particular structure where the pin portions of the crankshaft are mainly processed, lapping operations may be performed not only for the pin portions but also for the journal portions of the crankshaft and, if the occasion demands, lapping operation may be carried out on the target shaped peripheries with non-complete round shape in cross section, such as cam lobe portions or journal portions of a cam shaft. In addition, the present invention may also be applied to the other objective with a target profile in other circular-arc shaped configuration.

Further, while the surface finishing apparatus of the presently filed embodiment has been shown and described in conjunction with an structural example wherein the tool shifting mechanism is comprised of the oscillating mechanism 50 that is arranged to oscillate the workpiece support table 49 by which the workpiece W is oscillated in the lateral direction, the tool shifting mechanism may be modified such that the main spindle 41 is oscillated to cyclically move the workpiece along the axis thereof. In another alternative, the tool shifting mechanism may take a structure to directly oscillate the lapping film 11 or to directly oscillate both workpiece W and the lapping film 11. Also, the oscillating mechanism 50 is not limited to the particular structure that employs the eccentric rotary element 51, and the oscillating mechanism 50 may include an ultrasonic oscillator.

While the surface finishing apparatus of the presently filed embodiment has been shown and described in conjunction with an structural example wherein the oscillating position of the workpiece W is detected based on the rotational position of the eccentric rotary element 51 through the use of the rotary encoder S2, the surface finishing apparatus may take a modified structure upon using an optical sensor to directly detect the terminal end of the workpiece W for thereby detecting the oscillating position of the workpiece W.

Moreover, the surface finishing apparatus of the presently filed embodiment has been shown and described in conjunction with a structural example that includes the convex-shaped shoes, the surface finishing apparatus may use other types of shoe configurations.

Second Embodiment

Figure 8:
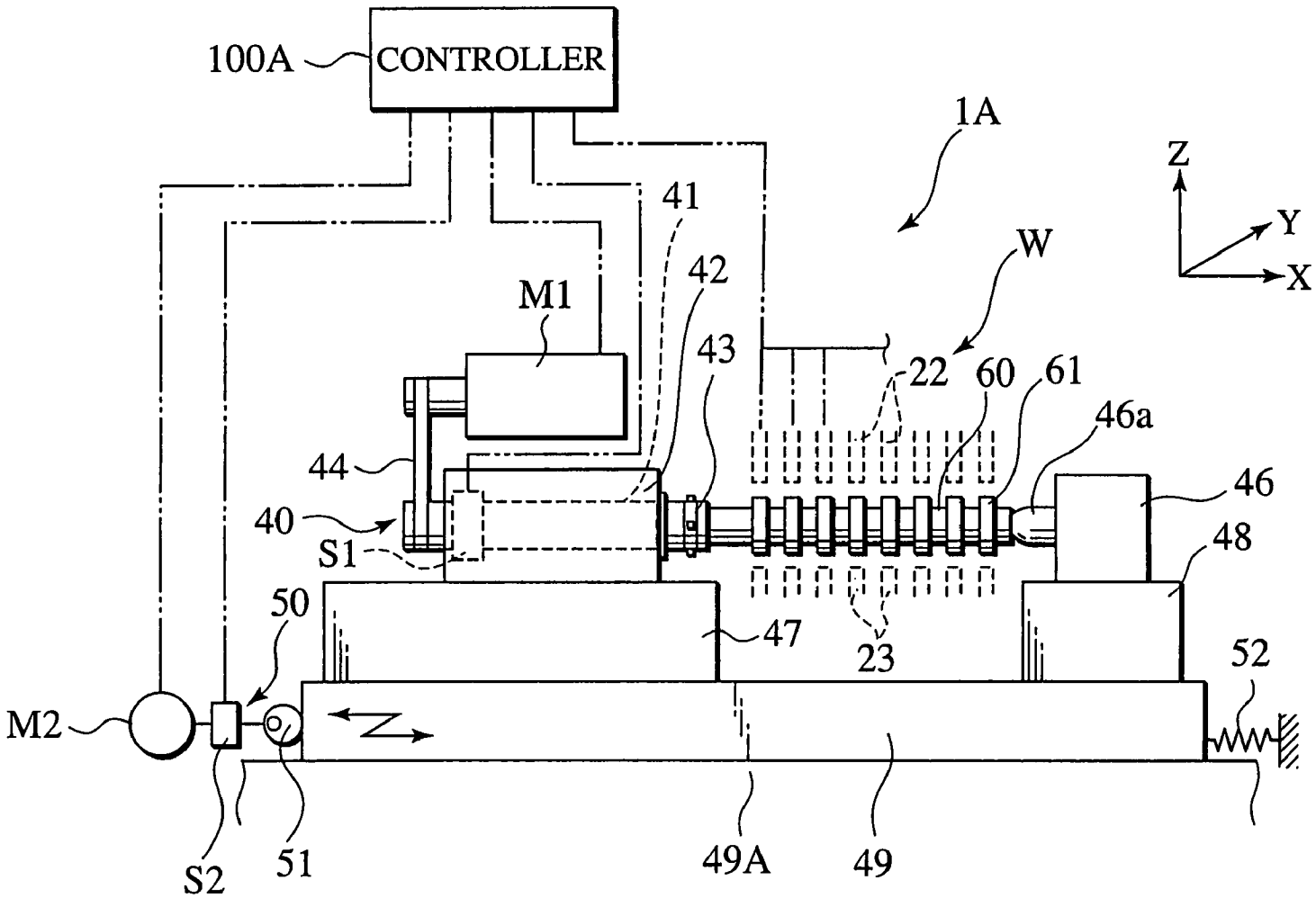
FIG. 8 is a schematic front view of a surface finishing apparatus, in the form of a lapping apparatus, of a second embodiment according to the present invention.
Figure 9:
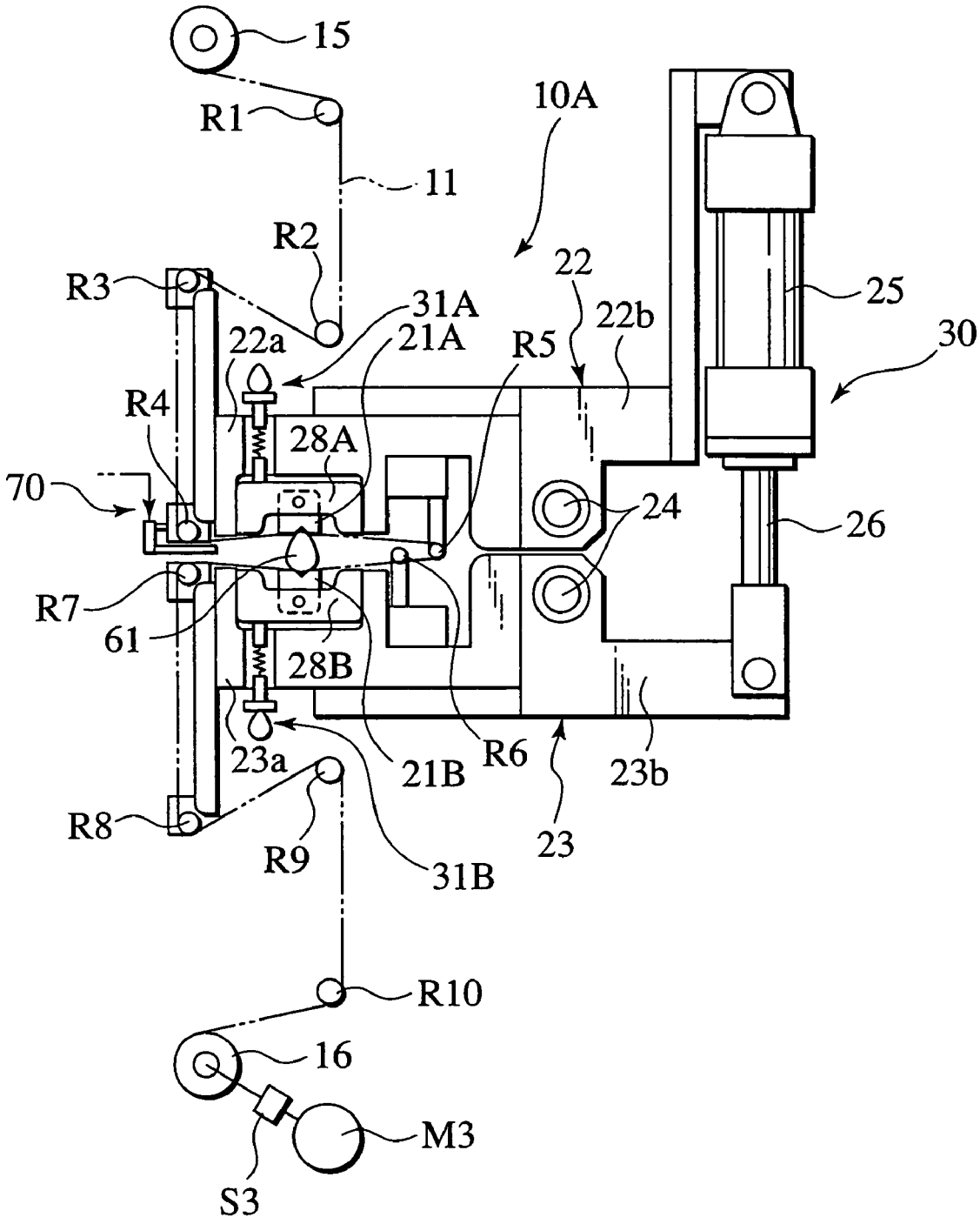
FIG. 9 is a schematic view, with a positional relation in correspondence with FIG. 2, showing a closed status of a pressure applying mechanism disposed in the surface finishing apparatus of FIG. 8 for opening and closing capabilities, in the second embodiment.
Figure 10:
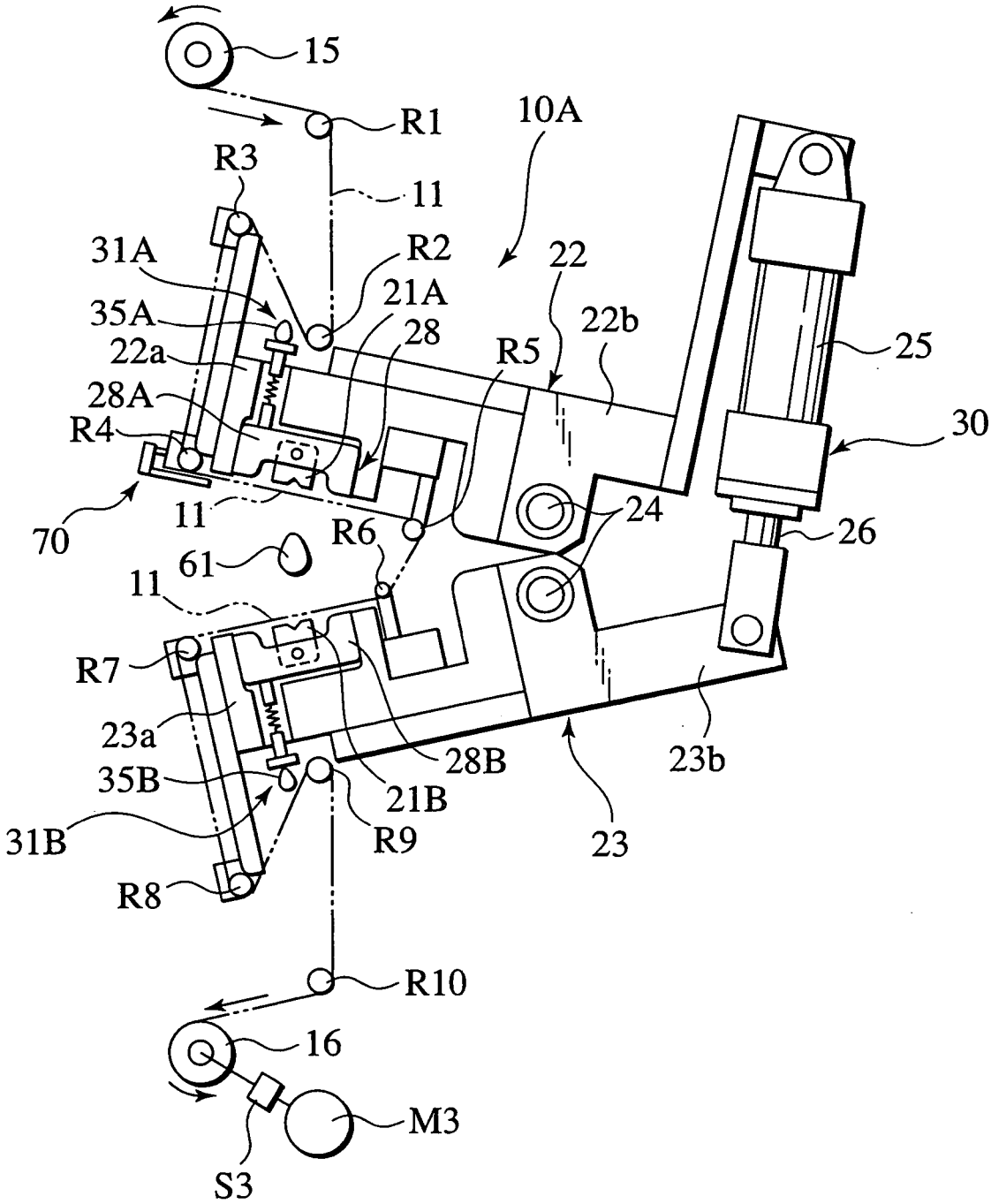
FIG. 10 is a schematic view showing an opened status of the pressure applying mechanism shown in FIG. 9, in the second embodiment.
Figure 11:
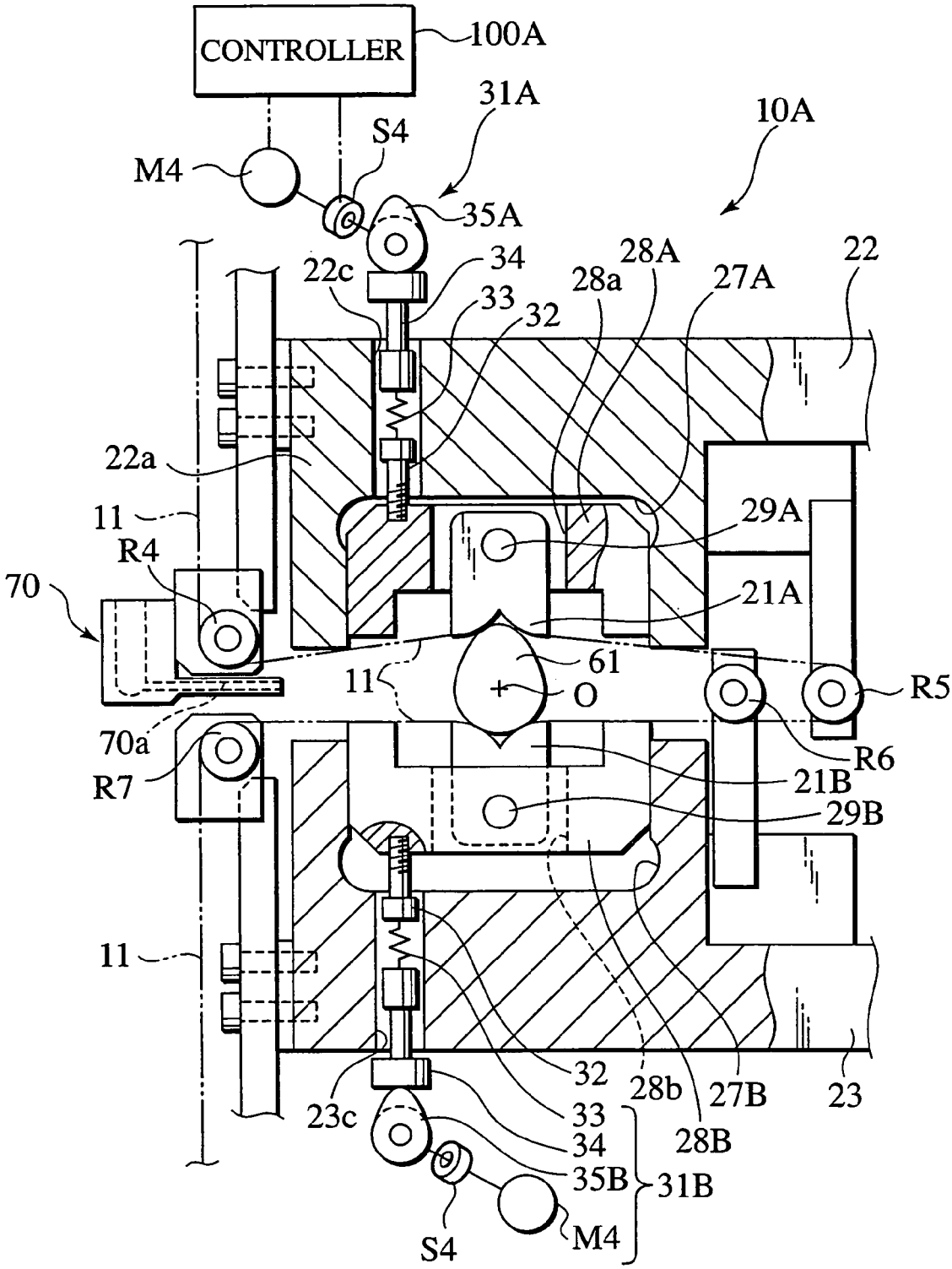
FIG. 11 is an enlarged partly cross sectional view showing an essential part of pressure applying mechanism forming part of the surface finishing apparatus of the second embodiment.
Figure 12:
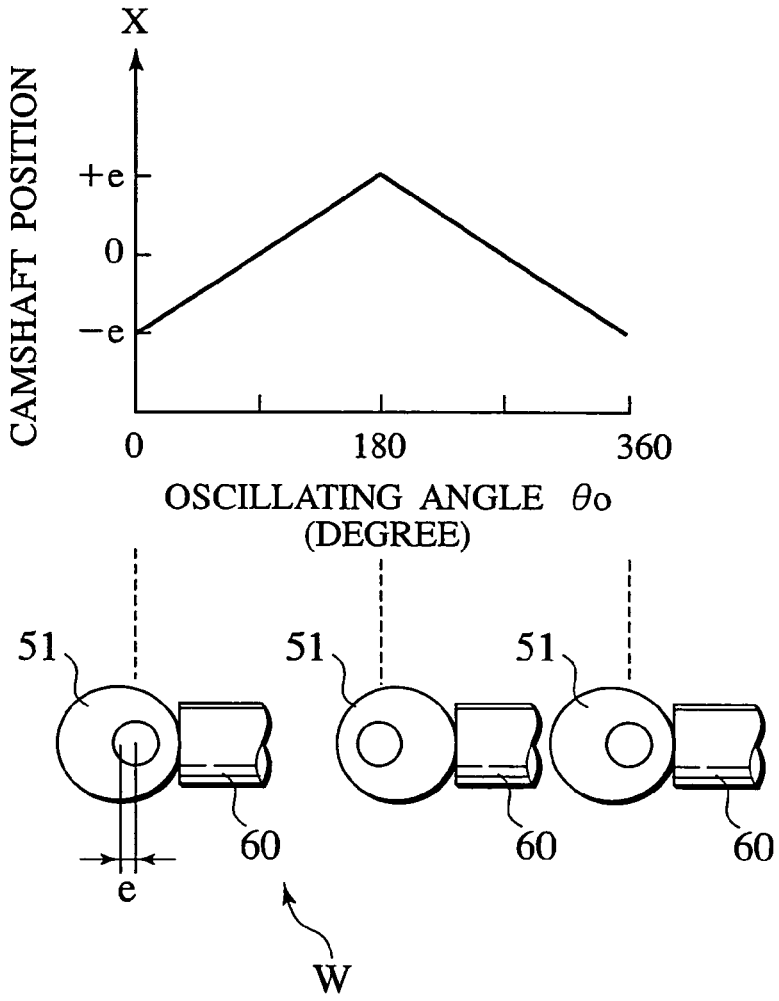
FIG. 12 is a view for illustrating the relationship between a cam shaft position and an oscillating angle of a workpiece, in the second embodiment.
Figure 13:
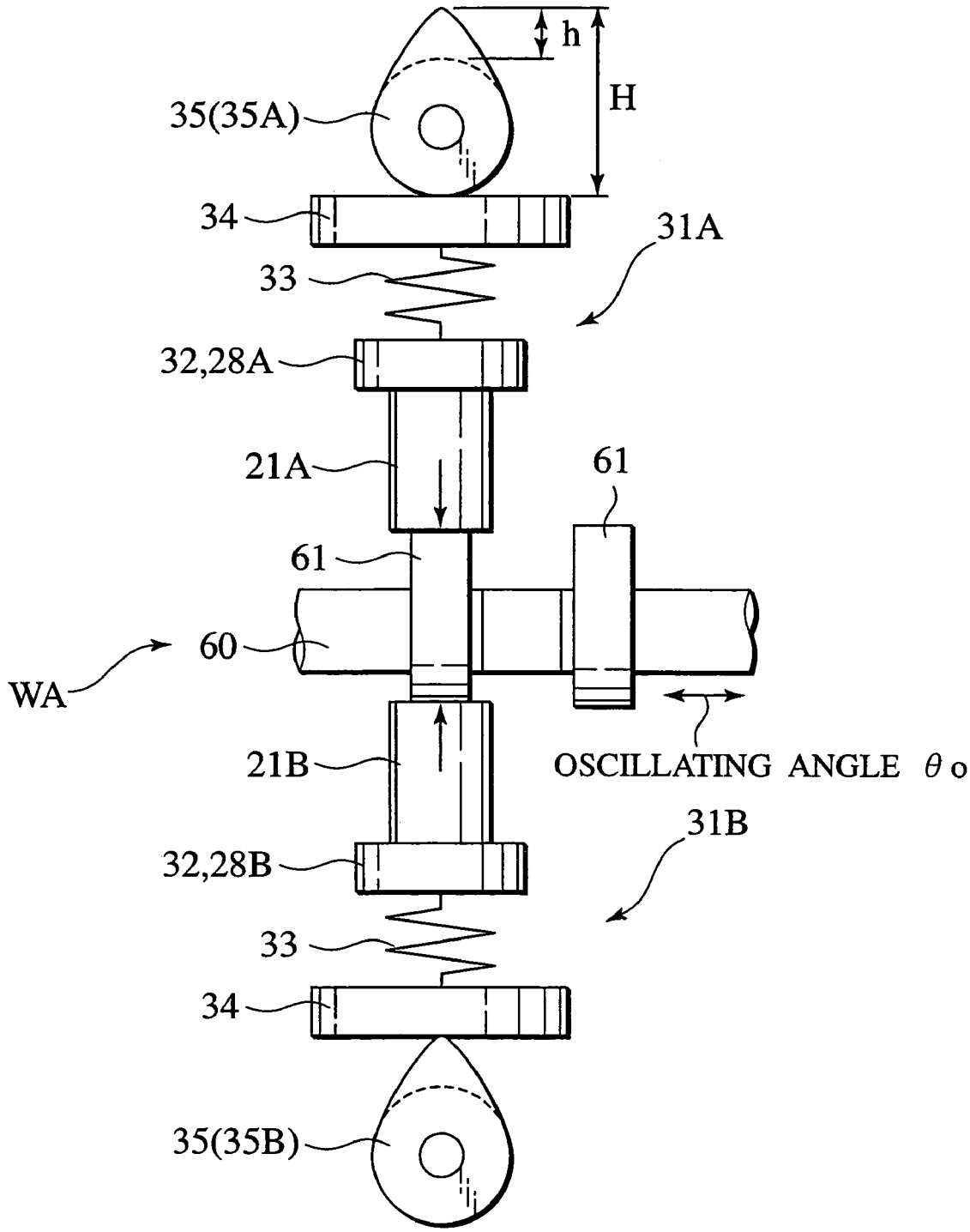
FIG. 13 is a conceptual view illustrating a structure equivalent to a structure of the pressure applying mechanism forming part of the surface finishing apparatus of the second embodiment.
Figure 14:
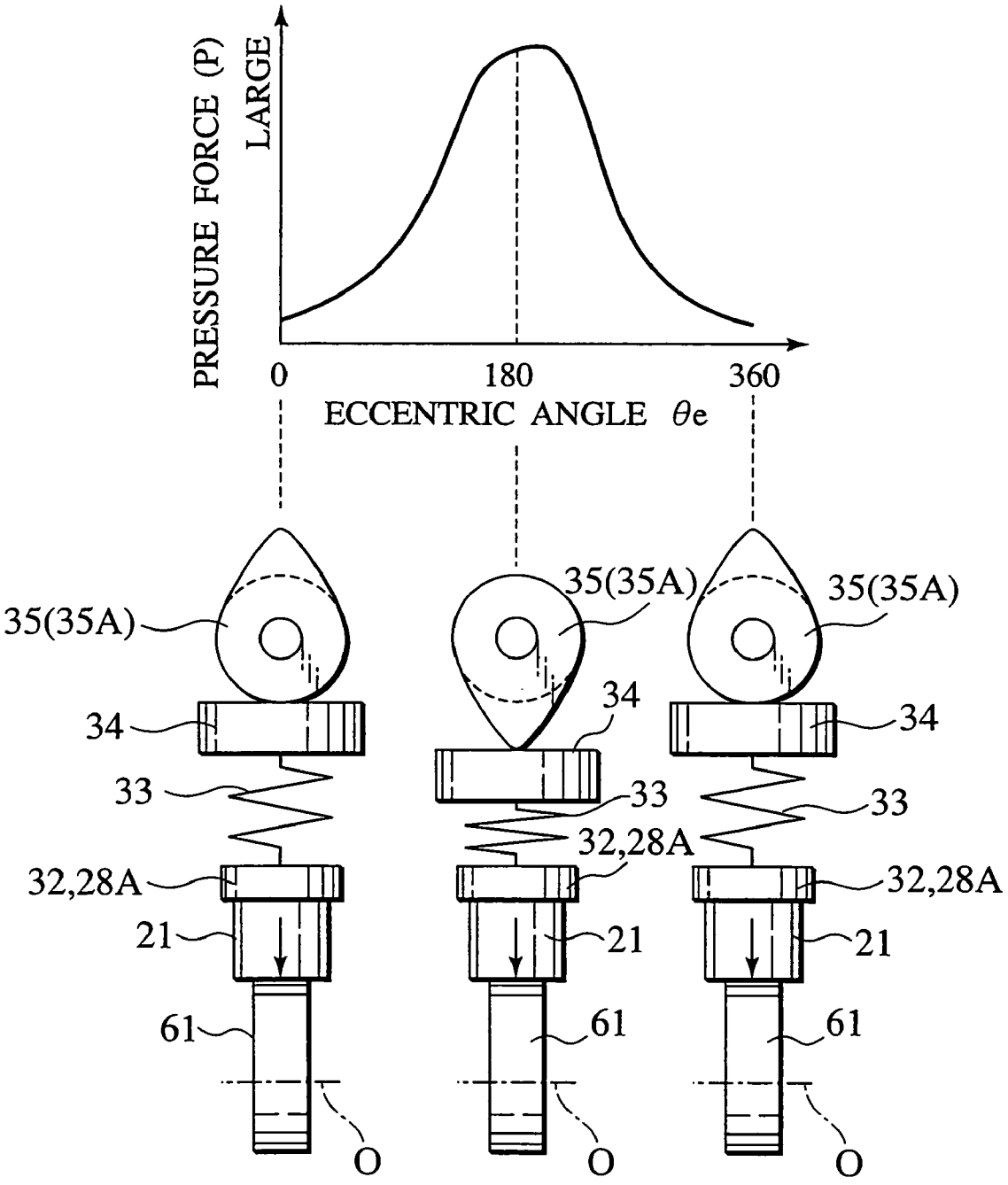
FIG. 14 is a view illustrating the relationship between a shoe pressure force and a rotational angle of an eccentric rotary element, in the second embodiment.
Figure 15A:
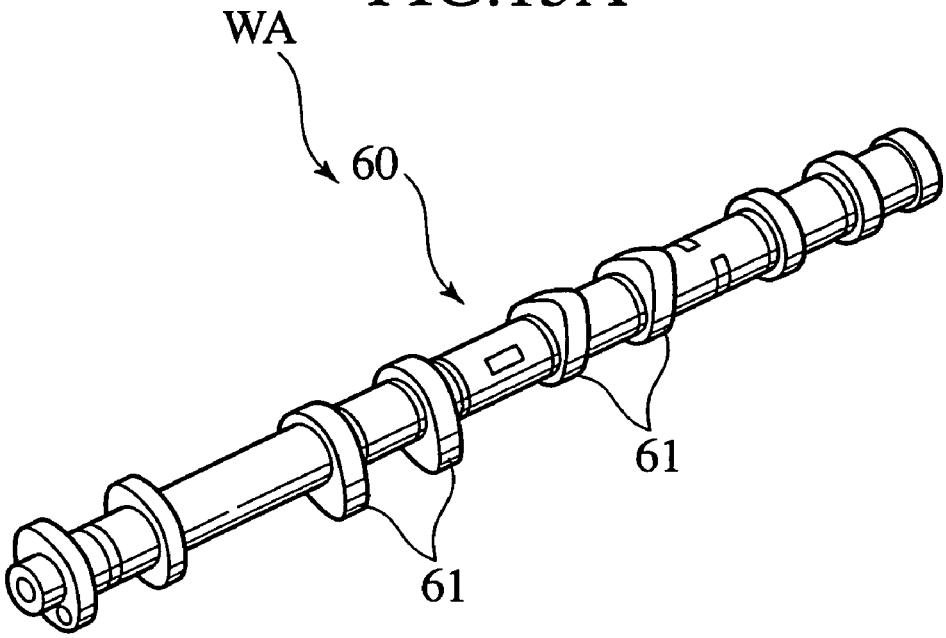
FIG. 15A is a perspective view showing the workpiece in the form of a cam shaft, in the second embodiment.
Figure 15B:
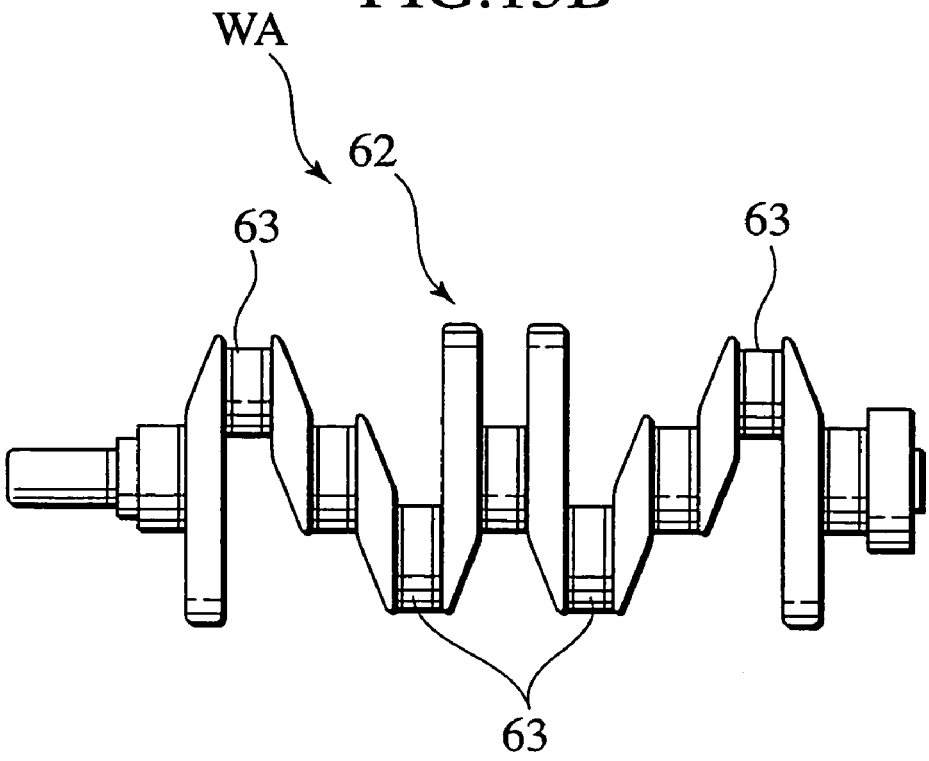
FIG. 15B is a perspective view showing the workpiece in the form of a crankshaft, in the second embodiment.

A surface finishing apparatus 1A of a second embodiment of the present invention is described below with reference to FIGS. 8 to 14 and FIGS. 15A and 15B. FIG. 8 is a schematic view illustrating the surface finishing apparatus 1A of the second embodiment of the present invention. FIG. 9 is a schematic view, with a positional relation in correspondence with FIG. 2, showing a pressure applying mechanism 10A, forming part of the surface finishing apparatus 1A, by which upper and lower presser arms, that are operative to assume open positions and closed positions, are retained in the closed positions. FIG. 10 is a schematic view showing the pressure applying mechanism 10A by which the upper and lower presser arms are retained in the open positions. FIG. 11 is an enlarged partly cross sectional view showing the presser mechanism, forming an essential part, of the surface finishing apparatus 1A of the presently filed embodiment. FIG. 12 is a view illustrating the relationship between a cam position and an oscillating angle. FIG. 13 is a schematic view showing a structure equivalent to a structure of the pressure applying mechanism 30. FIG. 14 is a view illustrating the relationship between a presser force and an eccentric angle of a cam. FIG. 15A is a perspective view showing an example of a workpiece in the form of a cam shaft to be machined. FIG. 15B is a perspective view showing another example of a workpiece in the form of a crankshaft to be machined.

The surface finishing apparatus 1A of the second embodiment differs from the surface finishing apparatus 1 of the first embodiment in that a cam shaft is employed as a workpiece and a controller 100A is arranged to control a pressure force to be applied by a pressure applying mechanism 10A in dependence on an oscillating position of the workpiecee resulting from a rotational position, indicative of an oscillating angle θc, of an eccentric rotary element 51 of an oscillating mechanism 50. In the presently filed embodiment, the same component parts as those of the surface finishing apparatus of the first embodiment bear like reference numerals and the surface finishing apparatus 1A is described below aiming at differing points in structure with explanation for the same component parts being simplified or omitted.

Referring to FIGS. 9 and 10, there is shown the pressure applying mechanism 10A operative to apply a pressure force to a surface finish tool, in the form of the lapping film 11, with the pressure force exhibiting a distribution pattern depending upon an axial direction of the workpiece such that the lapping film 11 is held in pressured contact with the target shaped periphery, with the pressure force exhibiting a distribution pattern depending upon an axial direction of the workpiece W. The lapping film 11 extends between the supply reel 15 and the winding reel 16 and is guided with the guide rollers R1 to R10. The guide rollers R1 and R10 are supported on the frame body (not shown) of the surface finishing apparatus 1A. Further, the guide rollers R3 to R5 are supported on the upper presser arm 22, and the guide rollers R6 to R9 are supported by the lower presser arm 23. A pair of guide rollers R3 and R4 are located on a front portion of the forward end 22*a* of the upper presser arm 22, and the guide roller R5 is located in an inside area of the upper presser arm 22 at a position close proximity to the upper pivot shaft 24.

Likewise, a pair of guide rollers R7 and R8 are located on a front portion of the forward end 23*a* of the lower presser arm 23, and the guide roller R6 is located in an inside area of the upper presser arm 23 at a position close proximity to the lower pivot shaft 24. With such an arrangement, the lapping film 11 is pulled out from the supply reel 15 and guided with the pair of first guide rollers R3 and R4, the second guide roller R5, the third guide roller R6 and the pair of fourth guide rollers R7 and R8 whereupon the lapping film 11 is taken up on the winding reel 16.

Supported in an intermediate area of the upper presser arm 22 between the guide roller R4 and the guide roller R5 is an upper shoe 21A, and supported in an intermediate area of the lower presser arm 23 between the guide roller R6 and the guide roller R7 is a lower shoe 21B. A cam lobe portion 61 of the cam shaft WA, that is rotatably supported with the headstock 42 and the tail stock 46 (see FIG. 8), remains at a central area between the upper and lower presser shoes 21A, 21B for a purpose to be described below.

Connected to the winding reel 16 is a motor M3. With the motor M3 being operated, the winding reel 16 is rotated and the lapping film 11 is progressively fed from the supply reel 15. In order to detect the amount of lapping film 11 delivered from the supply reel 16, a rotary encoder S3 is mounted onto a shaft of the winding reel 16 as a detection unit to detect rotational displacement thereof. The lock units are mounted to the frame body (not shown) in the vicinity of the supply reel 15 and the winding reel 16, respectively, and operative to apply the given tension force to an entirety of the lapping film 11.

The pair of upper and lower presser arms 22 and 23 are pivotally supported on the upper and lower pivot shafts 24, 24 to allow the forward end portions 22*a*, 23*a* of the upper and lower presser arms 22, 23 to be movable with respect to one another in the Z-direction for opening and closing capabilities. The upper and lower presser arms 22 and 23 are actuated by the fluid cylinder 25. With such a structure, if the piston rod 26 of the actuator 30 protrudes from a retracted condition, the upper and lower presser arms 22, 23 are pivoted in a direction to allow the forward end portions 22*a*, 23*a* of the upper and lower presser arms 22, 23 to fall in the closed position shown in FIG. 9. In the meantime, if the piston rod 26 is retracted from the protruding condition, the upper and lower presser arms 22, 23 are pivoted in the other direction to allow the forward end portions 22*a*, 23*a* of the upper and lower presser arms 22, 23 to fall in the open position shown in FIG. 10. Pivoting movements of the upper and lower presser arms 22, 23 allow the lapping film 11 to be moved in the same directions as the upper and lower presser arms 22, 23. Pivoting movements of the upper and lower presser arms 22, 23 in the closing directions allow the shoes 21A, 21B to be brought into abutting engagement with the cam lobe portion 61 by means of the lapping film 11. Also, pivoting movements of the upper and lower presser arms 22, 23 in the opening directions allow the shoes 21A, 21B to be brought out of abutting engagement with the cam lobe portion 61.

Although the upper and lower presser shoes 21A, 21B may be classified into convex type shoes and concave type shoes depending on outer profiles of the forward end portions of the shoes, in the illustrated second embodiment, the upper and lower presser shoes 21A, 21B are shown as concave type shoes, respectively, each of which has a concave distal end portion formed with plural lobes (shown as two lobes in the second embodiment) that are selectively brought into abutting engagement with a target shaped periphery of the cam lobe portion 61 by means of the lapping film 11. The distal end of each shoe is indented but has a pair of engaging surfaces per se, which mate with the workpiece WA, that are formed in convex circular arc configurations in cross section, respectively. Thus, the upper and lower presser shoes 21A, 21B are able to be brought into abutting engagement with the target shaped periphery of the cam lobe portion 61 at two line contacts though the lapping film 11 is intervened. Due to the presence of the cam lobe portion 61 being supported with the upper and lower presser shoes 21A, 21B at four contact points, the cam lobe portion 61 can be rotated in a stable and reliable fashion. Here, by the term "contact" used in the presently filed embodiment is meant that the upper and lower presser shoes 21A, 21B are brought into indirect abutting engagement with the target shaped periphery of the workpiece WA via the lapping film 11, and by the term "contact surface area" is meant the surface area in which the upper and lower presser shoes 21A, 21B are brought into indirect abutting engagement with the target shaped periphery of the workpiece WA via the lapping film 11.

As shown in FIG. 11, the forward end portions 22*a*, 23*a* of the upper and lower presser shoes 21A, 21B are formed with vertically inward cavities 27A, 27B, respectively, in which shoes cases 28A, 28B carrying the upper and lower shoes 21A, 21B, respectively, are slidably accommodated for protruding and retracting capabilities with respect to the workpiece WA. Disposed inside cavities 28*a*, 28*b* of the shoe cases 28A, 28B are upper and lower shoes 21A, 21B that are supported on pivot shafts 29A, 29B, respectively, for rocking movements. The upper and lower pivot shafts 29A, 29B are arranged to be aligned on a line segment intersecting a center 0 of the cam shaft 60 and to cause shoe pressure forces P to be efficiently applied to the lapping film 11. Also, reference numeral 70*a* designates a nozzle of the cooling unit 70 by which coolant is injected to an area close proximity to the target shaped periphery of the workpiece WA.

The pressure applying mechanism 10A includes upper and lower pressure adjusting units 31A, 31B associated with the forward end portions 22*a*, 23*a*, respectively, of the upper and lower presser arms 22, 23 for enabling the shoes 21A, 21B to hold the lapping fill 11 in pressured contact with the target shaped periphery, i.e., the cam lobe portion 61, of the workpiece W under the given pressure distribution pattern. Also, as conceptually shown in FIG. 13, each of the upper and lower pressure adjusting units 31A, 31B includes a connecting rod 32 whose distal end is connected to the shoe case (28A, 28B), a workpiece clamp spring 33 made of a coil spring, a presser rod 34 causing the workpiece clamp spring 33 to be resiliently compressed with respect to a rear end of the connecting rod 32, an eccentric rotary element (35A, 35B), serving as a lift adjustment element, held in abutting engagement with a head portion of the presser rod 34, and a presser motor M4 rotating and driving the eccentric rotary element 35. The connecting rod 32 and the presser rod 34 are slidably accommodated in a through-hole (22*c*, 23*c*) formed in the presser arm (22, 23). With the shoe cases 28A, 28B being depressed, the shoes 21A, 21B retained by the respective shoe cases 28A, 28B are pressed, thereby causing the abrasive grain surface of the lapping film 11 to be depressed against the cam lobe portion 61. A cam lift h of the eccentric rotary element 35 is equal to a product in which a base circle diameter is subtracted from a total height H of a cam, and the cam lift h defines a dimension to enable the presser rod 34 to move in the maximum distance. Thus, the workpiece clamp spring 33, the presser rod 34, the eccentric rotary element 35 and the presser motor M4 form each presser force adjusting unit (31A, 31B) for adjusting a shoe pressure force P.

As shown in FIG. 14, the shoe pressure force P varies in dependence on the rotational position of the eccentric rotary element 35 to allow the lapping film 11 to be applied with the shoe pressure forces P in a distribution pattern depending upon an axial direction of the workpiece WA. That is, an initial position (eccentric angle θe=0 degree) is assigned to be a position in which the base circle is brought into abutting contact with the head of the presser rod 34. When rotating the eccentric rotary element 35 from such an initial position through the eccentric angle θe of 180 degrees, the presser rod 34 is shifted by the cam lift h to cause the workpiece clamp spring 33 to be further resiliently deformed and, as a result, the shoe pressure force P takes the maximum value. If the eccentric rotary element 35 is further rotated through the eccentric angle θe of 360 degrees, the presser rod 34 is restored to the initial position and the shoe pressure force P is also restored to the same presser force as that of the initial position. In order to detect variation of such a shoe pressure force P, a rotary encoder S4 is mounted to detect the rotational position of the eccentric rotary element 35 (see FIG. 11).

Figure 16A:
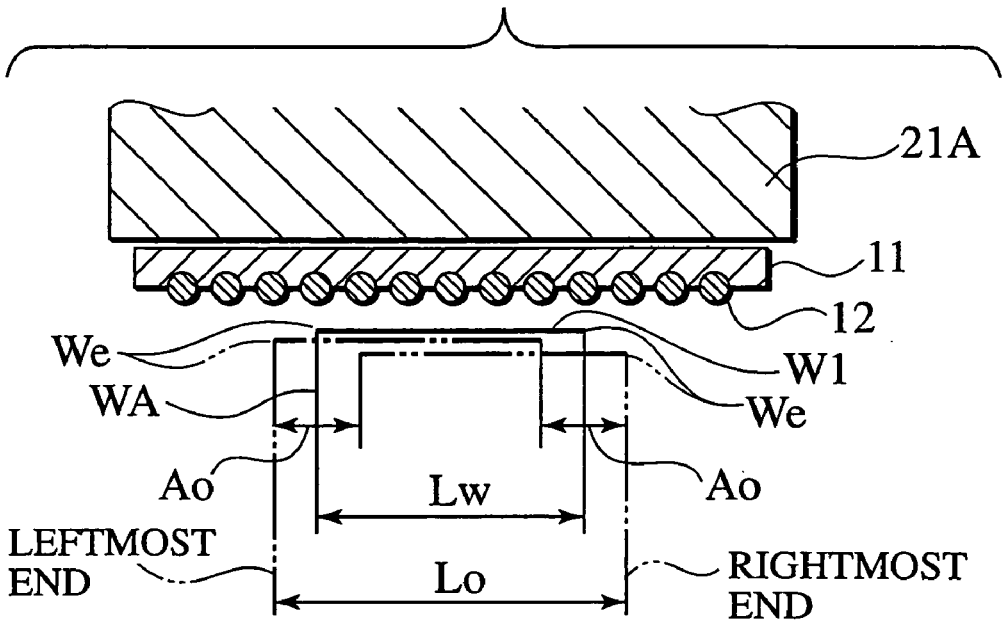
FIG. 16A is a view conceptually showing the relationship between a travel condition of the workpiece applied with oscillation and a lapping film, in the second embodiment.
Figure 16B:
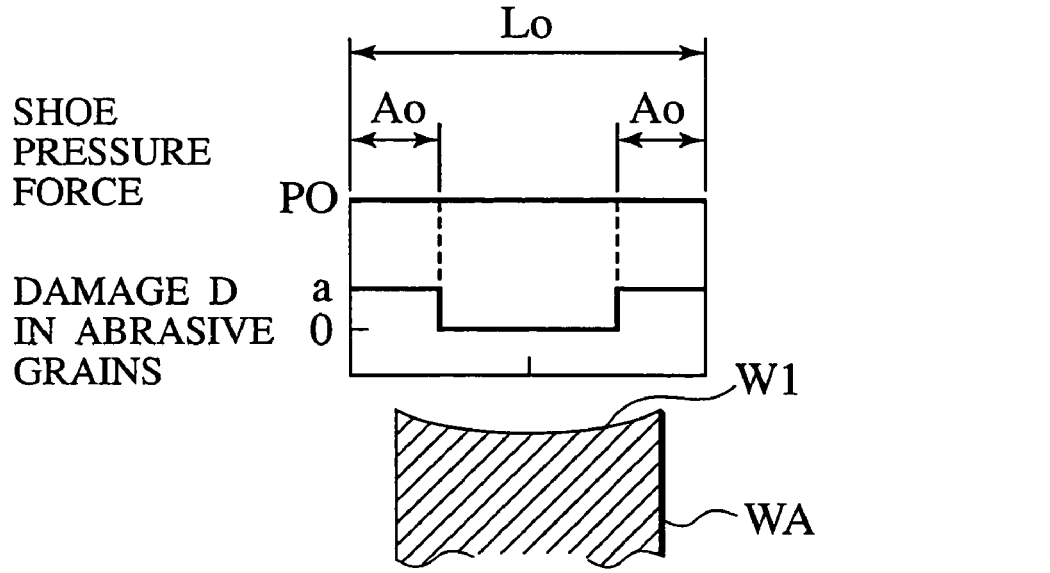
FIG. 16B is a view conceptually showing the degree of a damage encountered by abrasive grains resulting from edge portions of the workpiece that travels upon oscillation, in terms of a comparative example where a shoe pressure force is kept constant regardless of an oscillating position of the workpiece, and showing a geometrical profile of the workpiece along an axial direction of the workpiece as a result of lapping operation, in the second embodiment.

FIG. 16A is a view conceptually showing a shifted condition of the workpiece WA together with the lapping film 1, when applied with the oscillating motion. FIG. 16B is a view conceptually illustrating a degree of damage D encountered by the abrasive grains 12, suffered from edges We of the workpiece WA that moves accompanied by oscillation thereof, and a geometric shape along the axis of the workpiece WA, shown in an exaggerated form, as a result of lapping operation in a comparative example in which the shoe pressure force P is made constant regardless of the oscillating position of the workpiece WA.

Figure 17A:
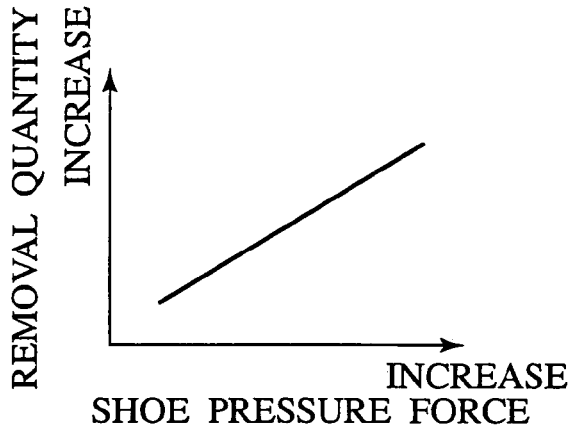
FIG. 17A is a view conceptually showing the relationship between a removal quantity of a target shaped periphery of the workpiece per unit time caused by the abrasive grains of the lapping film.
Figure 17B:
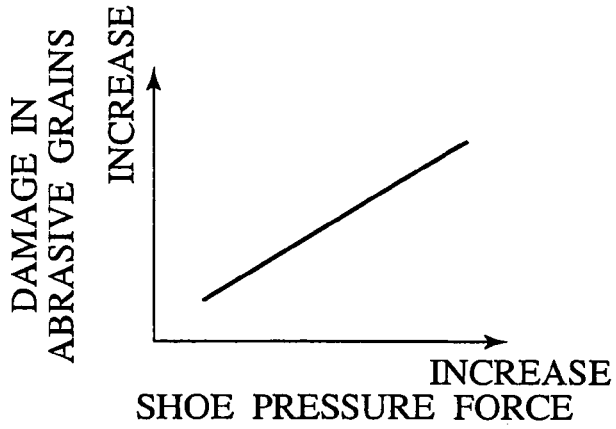
FIG. 17B is a view conceptually showing the relationship between the degree of the damage encountered by the abrasive grains resulting from the edge portions of the workpiece that travels upon oscillation and the shoe pressure force, in the second embodiment.
Figure 17C:
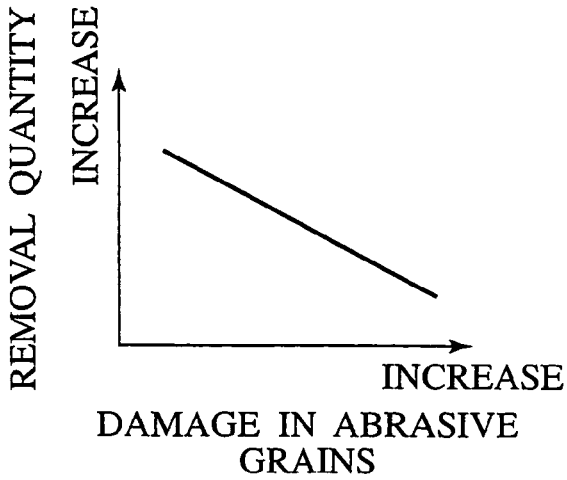
FIG. 17C is a view conceptually showing the relationship between the removal quantity of the target shaped periphery of the workpiece per unit time caused by the abrasive grains of the lapping film, with the shoe pressure force being kept constant, and the degree of the damage encountered by the abrasive grains of the lapping film, in the second embodiment.

Also, FIG. 17A conceptually shows the relationship between a removal quantity of the target shaped periphery W1 per unit time, resulting from the abrasive grains 12 of the lapping film 11, and the shoe pressure force P. FIG. 17B conceptually shows the relationship between the degree of damage D encountered by the abrasive grains 12 caused by the edges We of the workpiece WA that moves due to oscillation, and the shoe pressure force P. FIG. 17C conceptually shows the relationship between the removal quantity of the target shaped periphery W1 per unit time resulting from the abrasive grains 12 of the lapping film 11 and the degree of the damage D of the abrasive grains under a condition where the shoe pressure force P is kept constant.

In FIG. 16A, a solid line indicates a status wherein the target shaped periphery W1 of the workpiece WA assumes a central position with respect to the lapping film 11, a single dot line indicates a status wherein the target shaped periphery W1 of the workpiece WA is deviated to the leftmost end in the X-direction with respect to the central position of the workpiece WA and a double dot line indicates a status wherein the target shaped periphery W1 of the workpiece WA is deviated to the rightmost end in the X-direction with respect to the central position of the workpiece WA. In FIG. 16A, a reference symbol "Lw" designates a width of the target shaped periphery W1 along the axis of the workpiece WA, the reference symbol "Lo" indicates a width in which the workpiece WA is oscillated and the reference symbol "Ao" indicates an oscillating width of oscillation.

The abrasive grains 12 of the lapping film 11 encounter damages, such as cracks or fallouts in the worst case, resulting from the edge portions We, We of the workpiece WA that moves in oscillation. For this reason, as shown in FIG. 16B, the degree of the damage D encountered by the abrasive grains 12 due to the edge We of the workpiece WA substantially equals zero in the contact region of the lapping film 11 that is held in pressured contact with the target shaped periphery W1 of the workpiece WA at all times, and the degree of damage D of the abrasive grains increases in a region in which the edge portion We of the workpiece WA shifts. Such a degree of the damage D of the abrasive grains is assigned to be "a".

Here, the removal quantity of the target shaped periphery W1 of the workpiece WA per unit time due to the abrasive grains 12 of the lapping film 11 increases with an increase in the shoe pressure force P (see FIG. 17A). The damage D in the abrasive grains increases with an increase in the shoe pressure force P (see FIG. 17B). Under a condition where the shoe pressure force P is kept constant, the removal quantity of the target shaped periphery W1 per unit time caused by the abrasive grains 12 decreases with an increase in the damage D in the abrasive grains (see FIG. 17C).

Accordingly, in the comparative example, as shown in FIG. 16B, wherein the shoe pressure force P is held constant (as expressed as P=P0) regardless of the oscillating position of the workpiece WA, the removal quantity of the target shaped periphery W1 relatively increases at the central portion as compared to the both end portions, resulting in formation of the geometric shape into the mid-concave profile along the X-direction. Upon formation of the geometric shape into the mid-concave profile along the X-direction in such a manner, it is hard for the target shaped periphery W1 to have a straightness at a desired level, resulting in a fear of occurrence of defective surface finish.

Therefore, the surface finishing apparatus 1A of the second embodiment contemplates the provision of a structure wherein the rotational position (the oscillating angle θc) of the eccentric rotary element 51 using the rotary encoder S2 and the oscillating position of the cam shaft 60 is detected using the oscillating position θc whereupon the controller 100A operates to variably control the shoe pressure force P, to be applied to the lapping film 11 in the given distribution pattern depending upon the axial direction of the workpiece WA, in dependence on the oscillating position of the workpiece WA during surface finishing operation for thereby enabling the target shaped periphery W1 to be formed into a desired geometric profile along the axis of the workpiece WA.

Figure 18:
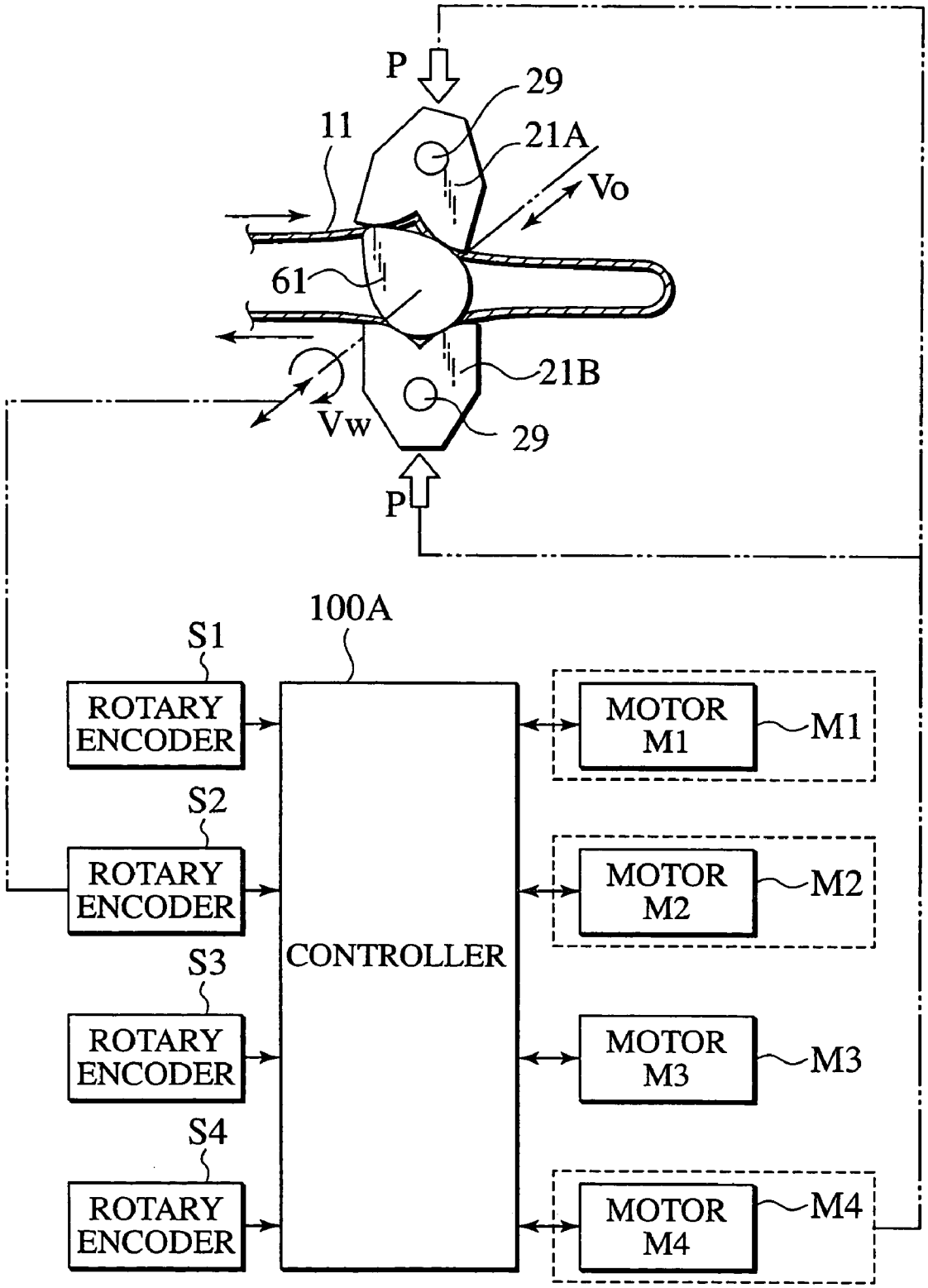
FIG. 18 is a schematic block diagram showing a control system of the surface finishing apparatus of the second embodiment shown in FIG. 8.
Figure 19A:
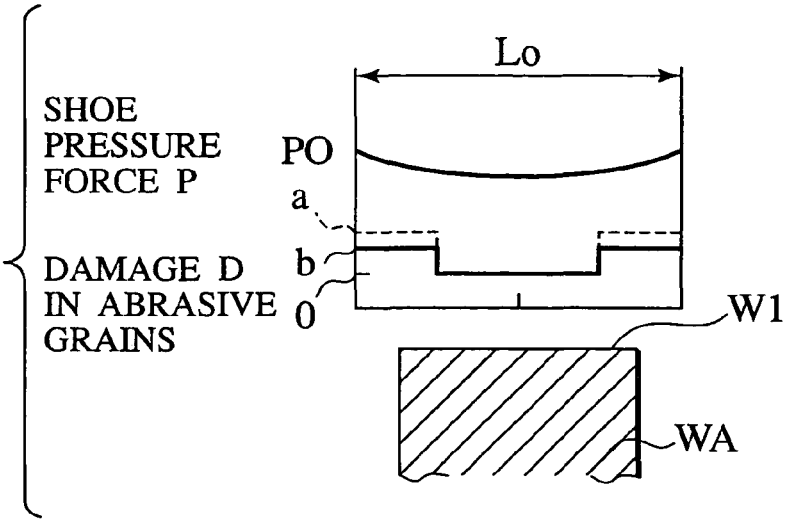
FIG. 19A is a conceptual view illustrating the relationship between a distribution pattern of the shoe pressure force, to be applied to shoes along an axial direction of the workpiece, and a resulting geometrical profile configured in a flat shape in cross section, in the second embodiment.
Figure 19B:
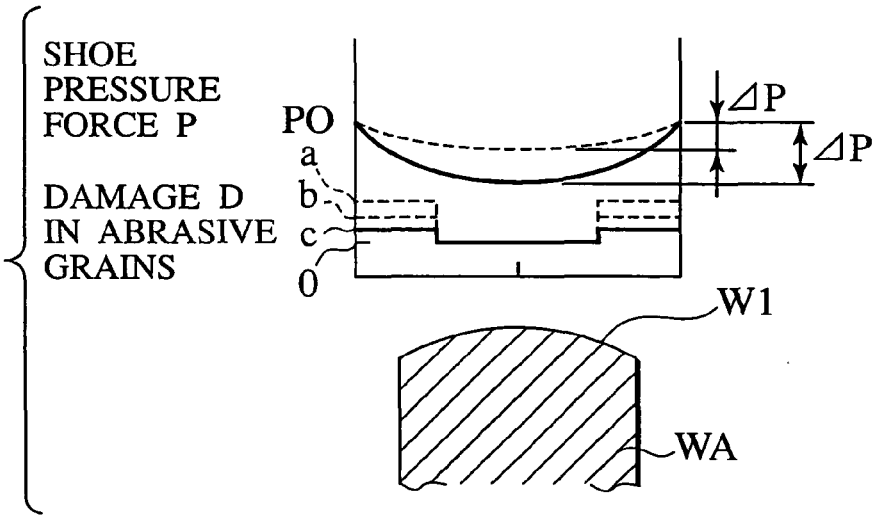
FIG. 19B is a conceptual view illustrating the relationship between a distribution pattern of the shoe pressure force, to be applied to shoes along an axial direction of the workpiece, and a resulting geometrical profile configured in a mid-convex shape in cross section, in the second embodiment.
Figure 19C:
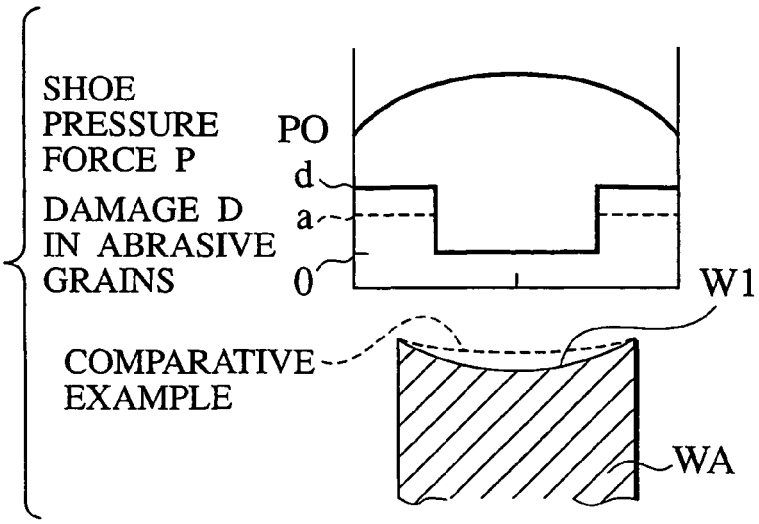
FIG. 19C is a conceptual view illustrating the relationship between a distribution pattern of the shoe pressure force, to be applied to shoes along an axial direction of the workpiece, and a resulting geometrical profile configured in a mid-concave shape in cross section, in the second embodiment.

A basic sequence of operations in control set forth above is described in detail with reference to FIG. 18 and FIGS. 19A to 19C. FIG. 18 shows a schematic block diagram illustrating a control system of the surface finishing apparatus 1A of the presently filed embodiment, and FIGS. 19A to 19C show control examples to indicate how the shoe pressure forces P are variably controlled in dependence on the oscillating position of the workpiece WA during surface finishing operation to allow the shoe pressure forces P to be applied to the target shaped periphery W1 of the workpiece WA, with the pressure force exhibiting the given distribution pattern depending upon the axial direction of the workpiece WA such that the target shaped periphery W1 is surface finished in a desired geometrical profile, contoured along the axial direction of the workpiece WA in cross section.

Referring to FIG. 18, the control system includes the controller 100A, that is mainly comprised of a CPU and memories, to which the rotary encoders S1 to S4 are connected to receive detection signals related to the rotational position of the cam lobe portion 61, the rotational position of the eccentric rotary element 35 with the shoe pressure force P being varied, and the rotational position of the eccentric rotary element 35 applied with oscillation, respectively. Also, the controller 100A is applied with detection signals related to the rotating speed of the main motor M1 by which the workpiece rotating speed Vw is determined and the rotating speed of the oscillating motor M2, by which the oscillating speed Vo is determined, respectively.

The controller 100A is responsive to the detection signal related to the rotational position of the eccentric rotary element 51 delivered from the rotary encoder S2 and discriminates to find whether the oscillating position of the cam shaft 60 is located. And, the controller 100A variably controls the shoe pressure forces P to be applied to the shoes 21A, 21B in dependence on the oscillating position of the cam shaft 60 along the axial direction thereof.

The shoe pressure forces P are variably controlled by the controller 100A in a manner described below. As shown in FIG. 19A, the controller 100A controls the operation of the pressure applying mechanism 10A, involving the pressure adjusting units 31A, 31B including the eccentric rotary elements 35A, 35B and motors M4, M4, M4 to apply the shoe pressure forces P to the shoes 21A, 21B to cause the lapping film 11 to be held in pressed contact with the target shaped periphery of the workpiece WA with the pressure force exhibiting the given distribution pattern depending upon the axial direction of the workpiece WA such that the shoe pressure forces P, to be applied to the lapping film 11 when the oscillating position of the workpiece WA assumes the terminal portions on the oscillating stroke of the workpiece W oscillating in the lateral direction, becomes greater than the shoe pressure forces P, to be applied to the lapping film 11 when the oscillating position of the workpiece WA assumes the central portion on the oscillating stroke of the workpiece W.

More particularly, the controller 100A outputs a control signal to the presser motor M4 to allow the presser motor M4 to be controllably rotated such that the eccentric angle θe of the eccentric rotary element 35 is angled at 180 degree when the oscillating position of the cam shaft 60 reaches the leftmost end (at the oscillating angle θc=zero degree) whereas the eccentric angle θe of the eccentric rotary element 35 is angled at zero degree when the oscillating position of the cam shaft 60 reaches the central position (at the oscillating angle θc=90 degree) and the eccentric angle θe of the eccentric rotary element 35 when the oscillating position of the cam shaft 60 reaches the rightmost end (at the oscillating angle θc=180 degrees) is angled at 180 degrees. With the eccentric angle θe being angled at 180 degrees, since the shoe pressure forces P are maximized (see FIG. 14), the shoe pressure forces P occurring when the oscillating position of the cam shaft 60 assumes both the terminal positions on the oscillating stroke of the workpiece W oscillating in the lateral direction becomes greater than those occurring when the oscillating position of the cam shaft 60 assumes the central position on the oscillating stroke of the workpiece W oscillating in the lateral direction.

When controlling the shoe pressure force P to be applied to the shoes in such a manner set forth above, as compared to the shoe pressure force P applied as shown in the comparative example in FIG. 16B, the damage D in abrasive grains, encountered in the region where the edge portion We of the workpiece WA is shifted, decreases as seen in FIG. 19A. The degree of resulting damage D in the abrasive grains is assigned to be "b" (which is expressed as a>b). By the decrease in the damage D in abrasive grains is meant the increase in the removal quantity of the target shaped periphery W1 per unit time as a result of lapping with the abrasive grains 12 under the same shoe pressure force P (see FIG. 17C). Also, since the shoe pressure forces P related to the central portion on the oscillating stroke of the workpiece W oscillating in the lateral direction decreases, the removal quantity caused per unit time at the central portion on the oscillating stroke of the workpiece W also decreases. These actions are combined to improve an evenness in the removal quantity between the both terminal portions and the central portion on the oscillating stroke of the workpiece WA to allow the geometric profile to be formed into a flat shape in cross section, thereby suppressing a drop in a straightness.

Also, while in FIG. 19A, for ease of understanding, the shoe pressure force P related to the both terminal positions on the oscillating stroke of the workpiece W oscillating in the lateral direction has been exemplarily shown to be adjusted in the same pressure distribution pattern as that of the shoe pressure force P0 in the comparative example, it is to be noted that, in actual practice in lapping operation, the pressure distribution pattern along which the shoe pressure force P varies is determined by taking an actual time interval, in which the surface finishing is performed, into consideration. This applies to other exemplary cases as shown in FIGS. 19B and 19C, respectively, which will be described below.

In usual practice, there are workpieces some of which are intended to have the geometric profiles each positively formed into a mid-convex configuration. In order to contemplate reduction in friction by decreasing a contact region between the cam lobe portion 61 and a valve lifter (not shown), there are some occasions where the axially extending geometric profile is desired to be formed into the mid-convex profile in cross section.

The shoe pressure force P when contemplating to obtain the axially extending geometric profile formed into the mid-convex shape is variably controlled in the same manner as described above. That is, as shown in FIG. 19B, the controller 100A operates to control the operation of the pressure applying mechanism 10A, involving the pressure adjusting units 31A, 31B, 10 such that the shoe pressure force P occurring when the oscillating position of the workpiece WA assumes the both terminal positions on the oscillating stroke of the workpiece W oscillating in the lateral direction, becomes greater than that occurring when the oscillating position of the workpiece WA assumes the central portion on the oscillating stroke of the workpiece W oscillating in the lateral direction. However, a change rate ΔP between the shoe pressure force P related to the both terminal portions on the oscillating stroke of the workpiece W oscillating in the lateral direction and the shoe pressure force P related to the central portion on the oscillating stroke of the workpiece W oscillating in the lateral direction when obtaining the geometric profile with the mid-convex shape is greater than that appearing when obtaining the geometric profile formed into the flat shape in cross section. In FIG. 19B, a broken line indicates variation in the shoe pressure force P to be applied when intended to obtain the geometric profile formed into the flat shape in cross section.

When controlling the shoe pressure force P in such a manner set forth above, the damage D in the abrasive grains, encountered in the region where the edge portion We of the workpiece WA is shifted, further decreases. The degree of resulting damage D in abrasive grains is assigned to be "c" (which is expressed as a>b>c). By a further decrease in the damage D in the abrasive grains is meant the further increase in the removal quantity of the target shaped periphery W1 per unit time as a result of lapping with the abrasive grains 12 under the same shoe pressure force P. Also, since the shoe pressure force P, related to the central portion on the oscillating stroke of the workpiece W oscillating in the lateral direction, further decreases, the removal quantity caused per unit time at the central portion on the oscillating stroke also further decreases. These actions are combined to allow the both terminal portions of the workpiece WA to be further promoted in lapping than the central portion of the workpiece WA to be performed, thereby enabling the axially extending geometric profile to be surface finished into the mid-convex shape.

In usual practice, there are workpieces some of which are intended to have axially extending geometric profiles each positively formed into a mid-concave configuration. That is, there are some occasions where pin portions 63 of a crankshaft 62 (see FIG. 15B) are desired to have axially extending geometric profile to be formed into mid-concave profiles.

The shoe pressure force P when contemplating to obtain the axially extending geometric profile formed into the mid-concave shape is variably controlled in a manner as shown in FIG. 19C. That is, the controller 100A operates to control operations of the pressure applying mechanism 10A, involving the pressure force adjusting units 31A, 31B, such that the shoe pressure force P, related to both the terminal portions on the oscillating stroke of the workpiece W oscillating in the lateral direction, becomes less than that related to the central portion on the oscillating stroke of the workpiece W oscillating in the lateral direction.

More particularly, the controller 100A outputs a control signal to the presser motor M4 to allow the presser motor M4 to be controllably rotated such that the eccentric angle θe of the eccentric rotary element 35 is angled at zero degree when the oscillating position of the crankshaft 62 reaches the leftmost end (at an oscillating angle θc=0 degree) whereas, when the oscillating position of the cam shaft 60 reaches the central position (at an oscillating angle θc=90 degrees), the eccentric angle θe of the eccentric rotary element 35 is angled at 180 degrees and, when the oscillating position of the crankshaft 62 reaches the rightmost end (oscillating angle θc=180 degrees), the eccentric angle θe of the eccentric rotary element 35 is angled at zero degree. With the eccentric angle θe being angled at 180 degrees, since the shoe pressure force P is maximized (see FIG. 14), the shoe pressure force P related to both the terminal portions on the oscillating stroke of the workpiece W oscillating in the lateral direction becomes less than that related to the central portion on the oscillating stroke of the workpiece W oscillating in the lateral direction.

When controlling the shoe pressure force P in such a manner set forth above, the damage D in the abrasive grains, encountered in the region where the edge portion We of the workpiece WA is shifted, becomes larger than the that obtained when applied with the shoe pressure force P shown in the comparative example of FIG. 16B. The degree of resulting damage D the in abrasive grains is assigned to be "d" (which is expressed as d>a). By the increase in the damage D in the abrasive grains is meant the decrease in the removal quantity of the target shaped periphery W1 per unit time as a result of lapping with the abrasive grains 12 under the same shoe pressure force P. Also, since the shoe pressure force P related to the central portion on the oscillating stroke of the workpiece W oscillating in the lateral direction increases, the removal quantity caused per unit time at the central portion on the oscillating stroke also increases. These actions are combined to cause lapping to be further promoted at the central portion of the target shaped periphery of the workpiece WA than that attained at the terminal portions of the target shaped periphery, enabling the axially extending geometric profile to be surface finished into the mid-concave shape in cross section.

Also, since the change rate between the shoe pressure force P related to the terminal portions on the oscillating stroke of the workpiece W oscillating in the lateral direction and the shoe pressure force P related to the central portion on the oscillating stroke of the workpiece W oscillating in the lateral direction varies depending on the axially extending geometric profile (to be formed into the flat, mid-convex and mid-concave shapes in cross section) of the workpiece, the surface finishing conditions (such as the shoe pressure force, the workpiece rotating speed and respective fundamental values in the oscillating speeds) based on which lapping operation is performed, and the surface roughness that is demanded, the change rate in the shoe pressure force should not be determined in a univocal fashion and a final change rate of the shoe pressure force may be determined in trial and error.

Further, in order to vary the shoe pressure force P in synchronism with the oscillating position of the workpiece WA, when designing the eccentric rotary element 35, a base circle radius and an operation start angle associated in terms of the X-direction are determined taking an oscillating cycle into consideration and, in respect of the Z-direction, the cam lift h and the operation start angle are determined.

Now, operation of the surface finishing apparatus of the presently filed embodiment is described in conjunction with an exemplary case where the target shaped periphery of the axially extending geometric profile is surface finished in the flat shape in cross section.

First, the cam shaft 60 is set between the headstock 42 and the tail stock 46 as the workpiece WA, and the upper and lower presser arms 22, 23 are moved toward the cam lobe portion 61. When this takes place, the fluid cylinder 25 is operated to retract the piston rod 26, thereby operating the upper and lower presser arms 22, 23 in the opening directions. Subsequently, the fluid cylinder 25 is actuated to cause the piston rod 26 to protrude the upper and lower presser arms 22, 23 in the closing directions. These closing movements allow the lapping film 11 to be set on the target shaped periphery W1, i.e., of the cam lobe portion 61, of the cam shaft 60 by means of the shoes 21A, 21B.

During opening movements of the upper and lower presser arms 22, 23, the motor M3 is operated to rotate the winding reel 16. Then, the lapping film 11 is shifted by a given length and a new abrasive grain surface is set onto the target shaped periphery W1. Thereafter, upon locking of the lock device disposed in the vicinity of the supply reel 15, if the winding reel 16 is rotated, the lapping film 11 is applied with a given tension force. Next, when locking the lock device in the vicinity of the winding reel 16, the lapping film 11 is brought into an operative condition with no looseness in tension.

When the cain lobe portion 61 is thus clamped in a manner set forth above, the pressure applying mechanism 10A is operated to cause both the shoes 21A, 21B to be brought into abutting engagement with the cam lobe portion 61, thereby compelling the abrasive grain surface of the lapping film 11 to be brought into pressured contact with the target shaped periphery W1.

And, the drive mechanism 40 is operated to cause the cam shaft 60 to rotate about the axial direction thereof while operating the oscillating mechanism 50 to allow the cam shaft 60 to oscillate in the X-direction along the axis thereof, the cam lobe portion 61 rotates followed by reciprocating movements of the shoe cases 28A, 28B, retaining the upper and lower shoes 21A, 21B, respectively, within the cavities 27A, 27B for expanding and retracting movements, thereby causing the target shaped periphery W1 of the cam lobe portion 61 to be lapped.

During such lapping operation, the controller 100A controls the oscillating mechanism 50 and the pressure applying mechanism 10A to be operated in synchronism with respect to one another. The controller 100A discriminates the oscillating position of the cam shaft 60 in dependence on the rotary position of the eccentric rotary element 35 detected by the rotary encoder S2 and variably controls the shoe pressure force P, to be applied to the shoes 21A, 21B, depending on the oscillating position of the cam shaft 60 during lapping operation. That is, the controller 100A controls the operation of the presser motor M4 such that, when the oscillating position of the cam shaft 60 reaches the leftmost end or the rightmost end, the eccentric rotary element 35 is angled at the eccentric angle θe of 180 degrees. This allows the shoe pressure force P related to the terminal portions on the oscillating stroke in the radial direction of oscillation of the workpiece WA to become greater than that related to the central portion on the oscillating stroke in the radial direction of oscillation of the workpiece WA (see FIG. 19A).

This improves the unevenness in the removal quantities that would occur between the both terminal portions and the central portion on the oscillating stroke of the cam lobe portion 61, and the axially extending geometric profile is formed in the flat shape in cross section, thereby suppressing a drop in the straightness. Thus, by merely adjusting the lapping conditions, it is possible to controllably surface finish the geometric profile of the target shaped periphery W1 along the axial direction of the workpiece WA.

The cam shaft 60 has a plurality of cam lobe portions 61, which are concurrently subjected to lapping operation. When lapping operation is completed, the fluid cylinder 25 is operated to contract the piston rod 26 for operating the upper and lower presser arms 22, 23 in the opening directions, thereby placing the cam shaft 60 in a condition available to be taken out. After the cam shaft 60 has been taken out, another cam shaft 60 is newly set and is enabled to be subjected to similar lapping operation.

Figure 20:
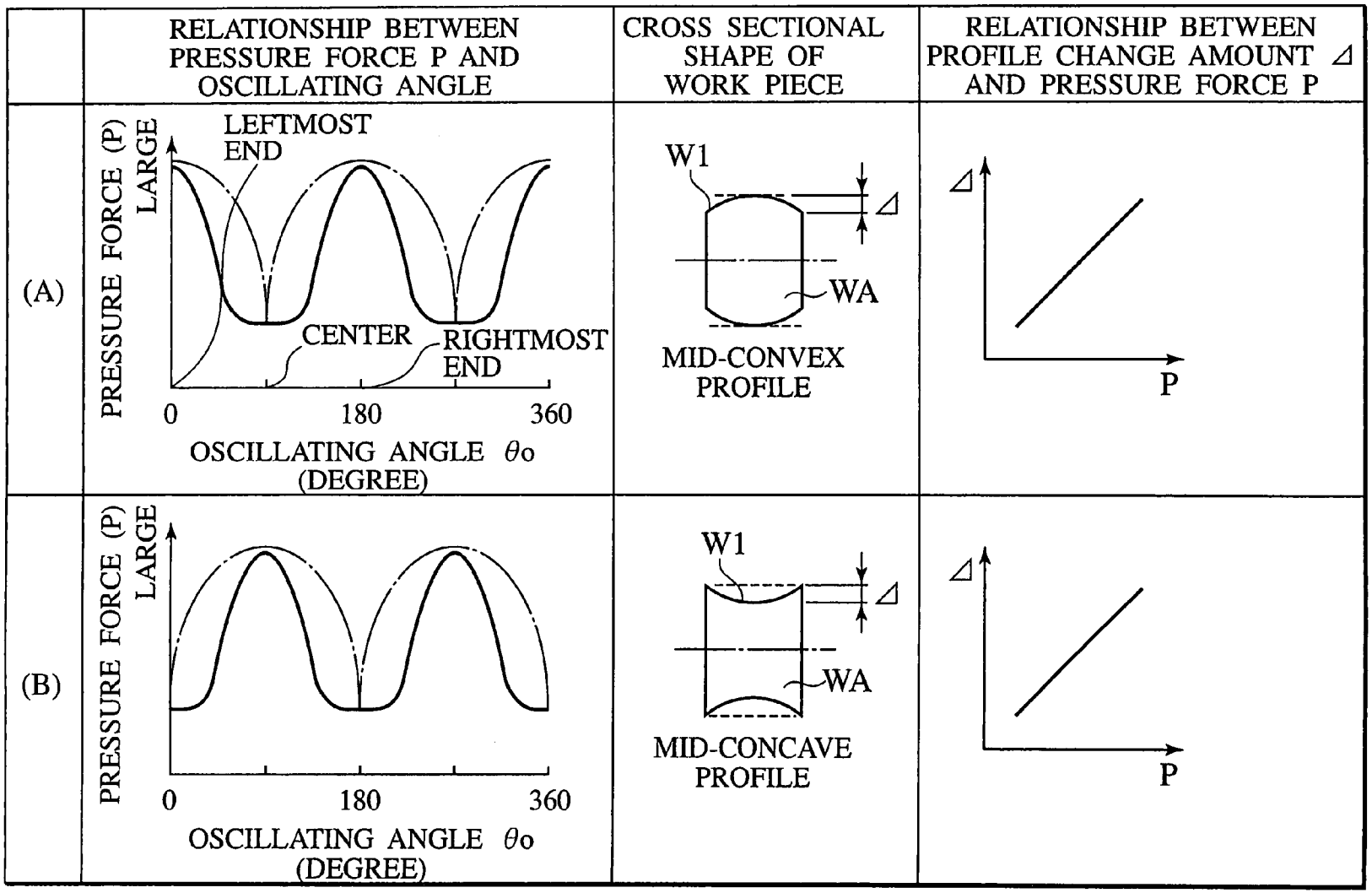
FIG. 20 is a diagram illustrating the relationship between the shoe pressure force P and an oscillating angle θo of the eccentric rotary element and the relationship between a cross sectional profile of the workpiece and a profile change amount Δ, and the shoe pressure force P, in the second embodiment.

FIG. 20 is a diagram showing the relationship between a shoe pressure force P and an oscillating angle θo, and the relationship between a cross-sectional shape of a workpiece, a geometric change quantity and the shoe pressure force P in a situation where the axially extending geometric profile is surface finished in a mid-convex shape or a mid-concave shape in cross section.

When surface finishing the axially extending geometric profile in the mid-convex shape in cross section, the lapping operation is controlled in such a manner set forth above. That is, the lapping operation is performed such that the change rate ΔP, related to the axially extending geometric profile to be surface finished in the mid-convex shape in cross section, between the shoe pressure force P related to the both terminal portions on the oscillating stroke of the workpiece W oscillating in the lateral direction and the shoe pressure force P related to the central portion on the oscillating stroke of the workpiece W oscillating in the lateral direction, is set to be greater than that required when lapping the geometric profile of the target shaped periphery in the flat shape in cross section (see FIG. 19B and a column (A) of FIG. 20.

This allows the both terminal portions of the target shaped periphery, i.e., the cam lobe portion 61, to be lapped in a further promoted extent than that at which the central portion is lapped, resulting in formation of the axially extending geometric profile in the mid-convex shape in cross section. Thus, by merely adjusting the lapping conditions, it is possible to controllably surface finish the geometric profile of the target shaped periphery W1 in a desired shape in cross section along the axis of the workpiece WA.

When lapping the axially extending geometric profile of the workpiece WA (such as the crankshaft 62) in the mid-concave shape in cross section, the controller 100A controls the operation of the presser motor M4 such that when the oscillating position of the crankshaft 62 reaches the central position, the eccentric angles θe of the eccentric rotary elements 35A, 35B are angled at 180 degrees, and the shoe pressure forces P related to the both terminal portions on the oscillating stroke of the workpiece W oscillating in the lateral direction are set to be smaller than that related to the central portion on the oscillating stroke of the workpiece W oscillating in the lateral direction (see FIG. 19C and a column (B) in FIG. 20).

This allows the central portion of the target shaped periphery W1 of the crankshaft 62 to be lapped in a further promoted extent than that at which the both terminal portions are lapped, resulting in formation of the axially extending geometric profile in the mid-concave shape in cross section. Thus, by merely adjusting the lapping conditions, it is possible to controllably surface finish the geometric profile of the target shaped periphery W1 in a desired shape in cross section depending upon the axial direction of the workpiece WA.

As set forth above, with the surface finishing apparatus 1A of the presently filed embodiment, due to the provision of the lapping film 11, the shoes 21A, 21B, the pressure applying mechanism 10A operative to urge the shoes 21A, 21B toward the workpiece WA to cause the abrasive surface of the lapping film 11 to be held in pressured contact with the target shaped periphery of the workpiece WA while enabling the shoe pressure forces P to be freely adjusted, the oscillation mechanism 50 serving as the tool shifting mechanism to cyclically move at least one of the workpiece WA and the lapping film 11 in the given stroke defined in relation to the given width of the target shaped periphery such that the working position of the lapping film 11 is shifted in variable positions with respect to the target shaped periphery, the rotary encoder S2 that detects the current relative oscillating position of the workpiece WA with respect to the lapping film 11 during oscillating movement and generates a detection signal indicative of the detected relative oscillating position, and the controller 100A responsive to the detection signal to variably control operation of the pressure applying mechanism so as to vary the shoe pressure forces P to be applied to the shoes 21A, 21B, with the pressure force exhibiting the given distribution pattern depending on the current oscillating position of the workpiece WA, the geometrical profile of the target shaped periphery W1 of the workpiece WA can be controlled along the axis of the workpiece WA. An advantageous effect is that upon mere adjustment of the lapping conditions, lapping operation can be carried out to surface finish the geometrical profile of the target shaped periphery W1 of the workpiece WA in any desired shape (flat, mid-convex or mid-concave shapes) in cross section along the axis of the workpiece WA.

Further, due to an ability of the controller 100A to control the operation of the pressure applying mechanism 10A in a way to allow the shoe pressure forces P appearing when the current oscillating position of the workpiece WA assumes both the terminal portions on the oscillating stroke of the workpiece W oscillating in the lateral direction to be set greater than those appearing when the current oscillating position of the workpiece WA assumes the central portion on the oscillating stroke, mere adjustment of the lapping conditions enables the geometrical profile of the target shaped periphery W1 of the workpiece WA to be surface finished in the flat or mid-convex shapes in cross section.

Furthermore, by operating the pressure applying mechanism 10A in a way to allow the lapping film 11 to be held in pressured contact with the target shaped periphery of the workpiece WA, with the pressure force exhibiting the given distribution pattern depending upon the axial direction thereof such that the change rate ΔP, between the shoe pressure force P related to the both terminal portions on the oscillating stroke of the workpiece W oscillating in the lateral direction and the shoe pressure force P related to the central portion on the oscillating stroke of the workpiece W oscillating in the lateral direction when required to surface finish the axially extending geometric profile in the mid-convex shape in cross section, is set to be greater than that required when surface finishing the geometric profile of the target shaped periphery in the flat shape in cross section, the geometrical profile, can be surface finished either in the flat or mid-convex shapes in cross section.

Moreover, due to the presence of the controller that controls the operation of the pressure applying mechanism such that the shoe pressure forces related to both the terminal portions on the oscillating stroke in the lateral direction of oscillating movement becomes smaller than those related to the central portion on the oscillating stroke, merely adjusting the lapping conditions allows the geometrical profile of the target shaped periphery W1 of the workpiece WA to be surface finished in the mid-concave shape in cross section.

In addition, the surface finishing apparatus 1A of the presently filed embodiment achieves to realize a lapping method for controllably surface finishing the geometrical profile of the target shaped periphery W1 of the workpiece WA by detecting a current relative oscillating position of the workpiece WA relative to the lapping film 11 during oscillating movement using the rotary encoder S2, and variably controlling the shoe pressure forces to be applied to the shoes depending on the current oscillating position of the workpiece WA detected by the rotary encoder 52 during lapping operation. As set forth above, an advantageous result resides in that merely adjusting the lapping conditions allows the lapping operation to be carried out to surface finish the geometrical profile of the target shaped periphery W1 of the workpiece WA in a desired shape (flat, mid-convex or mid-concave shapes) in cross section depending upon the axial direction of the workpiece WA.

Modified Form of Second Embodiment

Figure 21:
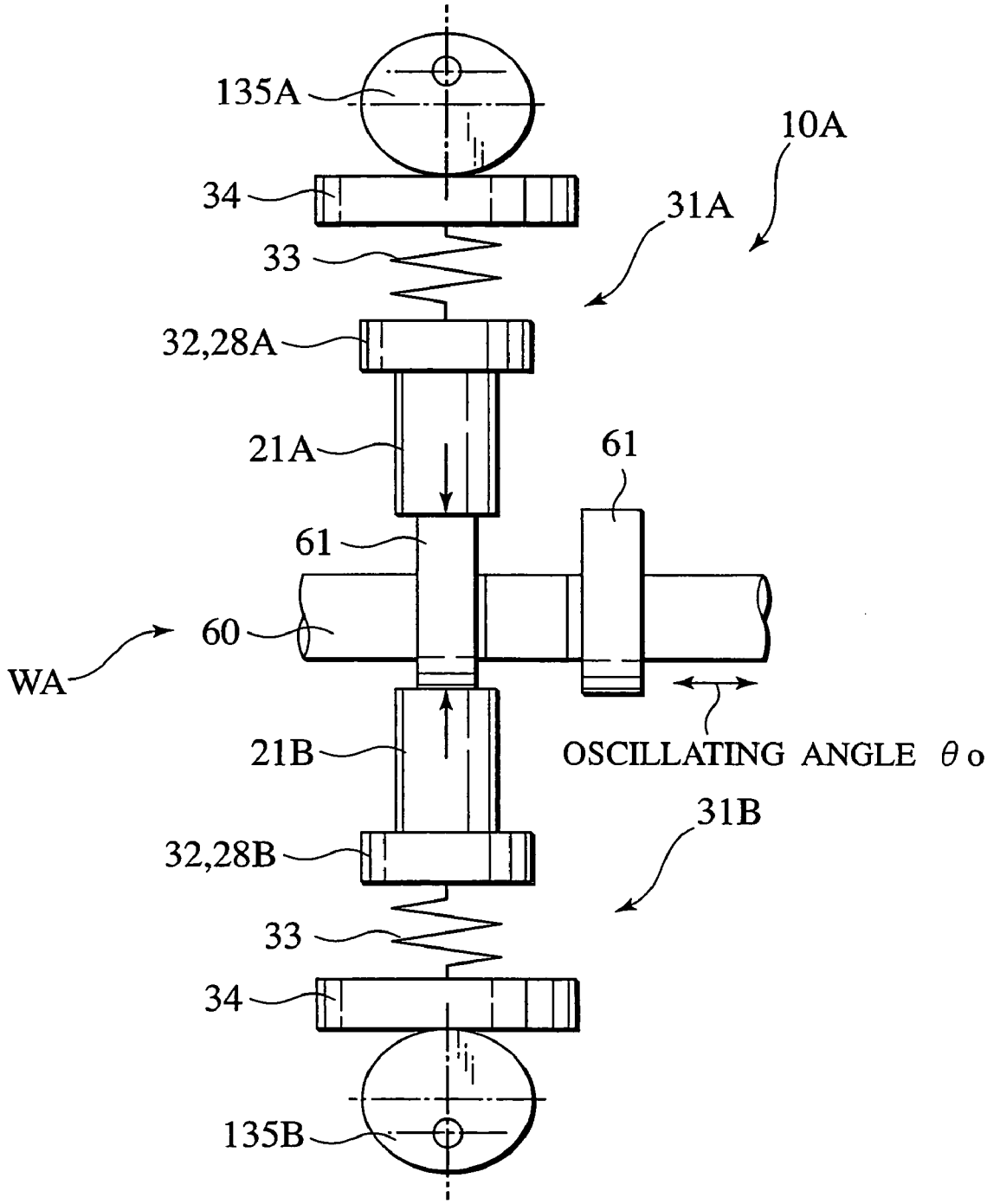
FIG. 21 is a conceptual view illustrating a structure equivalent to a structure of the pressure applying mechanism forming part of a modified form of the surface finishing apparatus of the second embodiment.

FIG. 21 is a schematic view showing a modified form of the pressure applying mechanism 10A of the second embodiment shown in FIG. 13, with the same component parts as those of the second embodiment bear like reference numerals to omit redundant description.

The modified form shown in FIG. 21 differs from the second embodiment in structure in that eccentric rotary elements 135A and 135B, which are respectively replaced with the eccentric rotary elements 35A and 35B employed in the second embodiment and each of which is held correspondingly in abutting engagement with the head of the presser rod 34, respectively have an elliptical shape different from the cam shaped eccentric rotary elements 35A and 35B. Although as shown in FIG. 20, the use of the cam shaped eccentric rotary elements 35A and 35B provides the shoe pressure force P that varies in a relatively sharp fashion, the use of the eccentric rotary elements 135A and 135B respectively having the elliptical shapes provides a shoe pressure force P that varies in a relatively gradual manner as represented by a single dot line in FIG. 20.

While the presently filed embodiment has been described with reference to a particular structure where the cam lobe portions 61 of the cam shaft 60 or the pin portions 63 of the crankshaft 62 are lapped to obtain the desired geometrical profile along the axial direction of the workpiece WA, the lapping operations may be performed not only for the cam lobes 61 of the cam shaft 60 but also for the journal portions 63 of the crankshaft 62. And, if the occasion demands, the lapping operation may be carried out for circu1ar-arc shaped target peripheries with an incomplete circular shape in cross section, and the present invention may also be applied to the other objective with a target profile in other circular-arc configuration.

In particular, the target shaped periphery of the workpiece is not limited to the pin portions of the crankshaft or the cam lobe portions of the cam shaft, the surface finishing apparatus of the presently filed embodiment may have other applications to a variety of workpieces.

Further, although the presently filed embodiment has been shown and described with reference to the pressure applying mechanism 10A, for adjustably controlling the shoe pressure forces to be applied to the shoes 21A, 21B to allow the lapping film 11 to be held in pressured contact with the target shaped periphery of the workpiece, with the pressure force exhibiting the given distribution pattern depending upon the axial direction thereof, that includes the pressure adjusting units 31A, 31B composed of the workpiece clamp springs 33, the eccentric rotary elements 35A, 35B and the presser motors M4, M4, the pressure applying mechanism 10A may be suitably altered. In particular, a fluid cylinder adapted to be actuated by air under pressure may be employed to allow the shoes 21A, 21B to be pressed such that the abrasive surface of the lapping film 11 is brought into pressured contact with the workpiece WA, with the pressure force exhibiting the given distribution pattern depending upon the axial direction thereof. In such case, air under pressure to be supplied to the fluid cylinder may be adjusted or a direction in which air under pressure is supplied to the fluid cylinder may be switched over through the use of electromagnetic valves for thereby adjusting the pressure distribution pattern in which the shoe pressure forces P are applied to the shoes.

Further, while in the surface finishing apparatus of the presently filed embodiment, the tool shifting mechanism has been shown and described as comprised of the oscillating mechanism 50 that is arranged to oscillate the workpiece support table 49 by which the workpiece W is oscillated in the lateral direction, the tool shifting mechanism may be modified such that the main spindle 41 adapted to support the workpiece WA is oscillated to cyclically shift the workpiece depending upon the axial direction thereof. In another alternative, the tool shifting mechanism may take a structure to directly oscillate the lapping film 11 or to directly oscillate both workpiece W and the lapping film 11. Also, the oscillating mechanism 50 is not limited to the particular structure that employs the eccentric rotary element 51, and the oscillating mechanism 50 may include an ultrasonic oscillator.

While in the surface finishing apparatus of the presently filed embodiment, a structural example has been shown and described wherein the oscillating position of the workpiece W is detected based on the rotational position of the eccentric rotary element 51 detected by the rotary encoder S2, the surface finishing apparatus may take a modified structure in which an optical sensor is employed to directly detect the terminal end of the workpiece W for thereby detecting the oscillating position of the workpiece W.

Moreover, the surface finishing apparatus of the presently filed embodiment has been shown and described in conjunction with an structural example that includes the shoes having engaging surfaces formed in the concave shapes, the present invention may be applied to a case where the distal end of each shoe is formed in a convex-shaped circular-arc profile.

Third Embodiment

Figure 22:
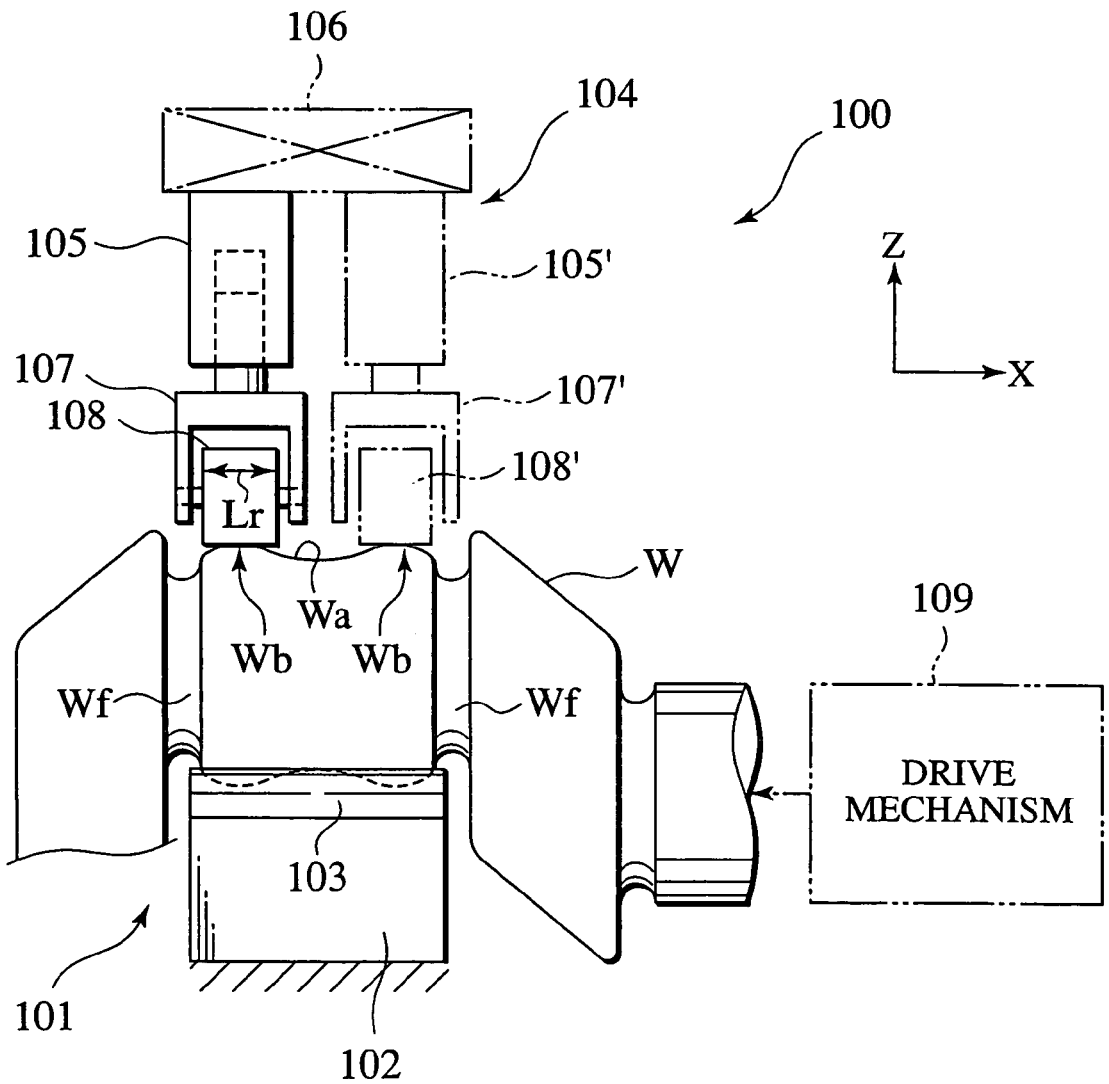
FIG. 22 is a schematic structural view of a surface finishing apparatus, in the form of a roller burnishing apparatus, of a third embodiment according to the present invention.
Figure 23:
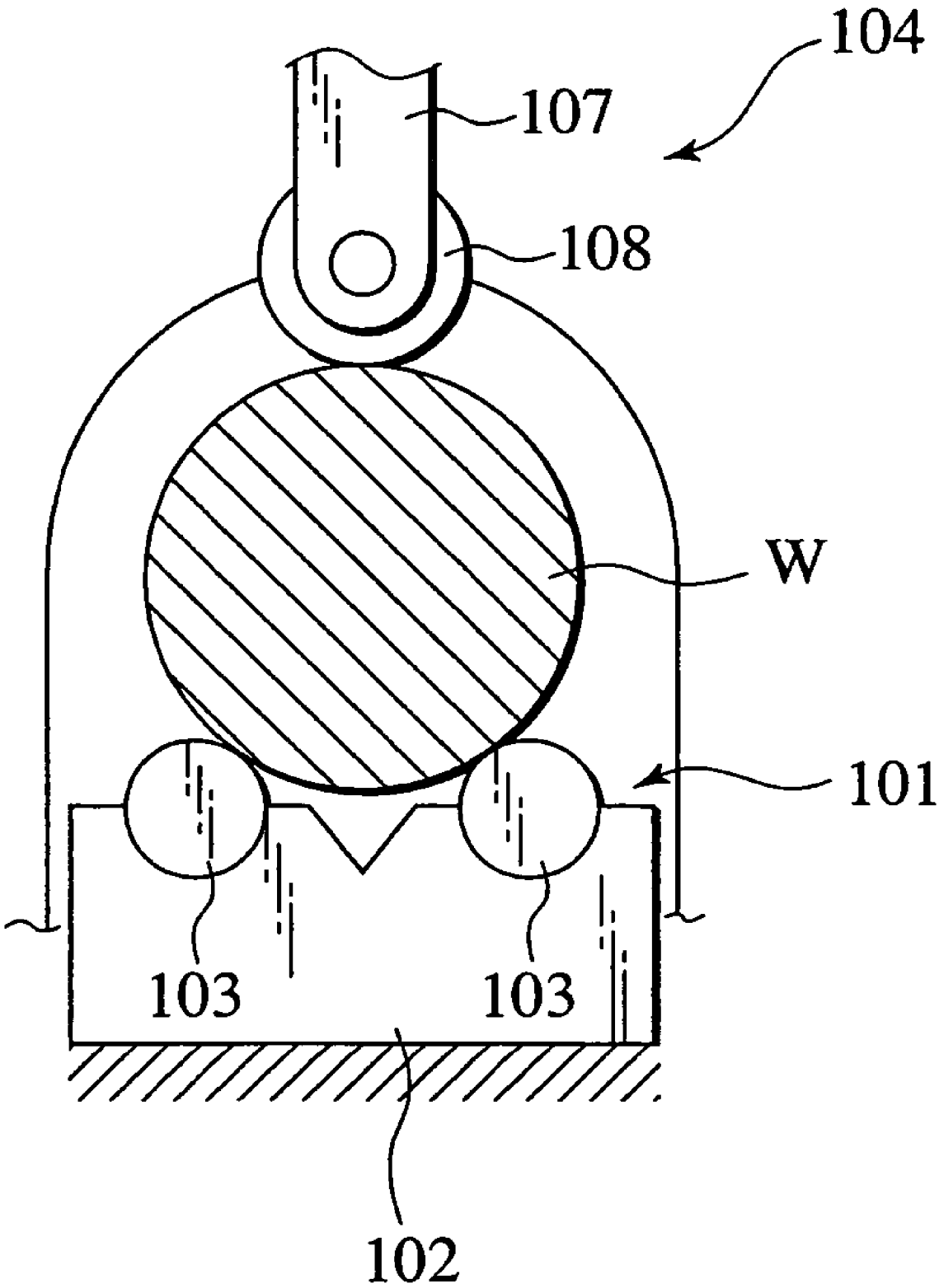
FIG. 23 is a side view of an essential part of the surface finishing apparatus shown in FIG. 22, in the third embodiment.

FIG. 22 is a schematic view of a surface finishing apparatus of a third embodiment of the present invention, and FIG. 23 is a cross sectional view of the surface finishing apparatus shown in FIG. 22, with a pin portion of a workpiece being indicated in a slightly exaggerated form.

The surface finishing apparatus of the third embodiment differs from the first embodiment in that the surface finishing apparatus of the presently filed embodiment takes the form of a roller burnishing apparatus which allows roller burnishing process to be applied to the workpiece W, which is preliminarily lapped in a surface finish with a mid-concave profile in cross section as shown in FIG. 5 whereby a surface finish tool, in the form of a burnishing roller, is held in pressured contact with the workpiece W with a pressure force exhibiting a given distribution pattern depending upon an axial direction of the workpiece. Therefore, the same component parts as those of the first embodiment bear like reference numerals to simplify or omit description of these component parts.

The surface finishing apparatus 100 of the third embodiment contemplates to perform roller burnishing on the sharp edges of both the terminal portions of the mid-concave profile formed in the target shaped periphery, i.e., the pin portion, of the crankshaft W subsequent to preceding lapping operation for thereby flattening the sharp edges on both the terminal portions of the mid-concave profile of the target shaped periphery. In particular, the surface finishing apparatus 100 of the third embodiment operates to roller burnish the sharp edges $T_1$ (see FIGS. 5 and 6) of both the terminal portions Wb, Wb of the pin portion of the crankshaft W so as to smooth out the sharp edges and sags caused by the tool break, thereby improving the surface roughness to obtain surface hardness, wear-resistance, fatigue and corrosion resistance, straightness and increased strength on the target shaped periphery of the workpiece. Incidentally, the mid-concave profile may be formed by such as dropped-out abrasive grains and lapped chips, which could not be discharged out with the lubricating liquid, during lapping process.

Referring now to FIGS. 22 and 23, there is shown the surface finishing apparatus 100 of the third embodiment in the form of the roller burnishing apparatus. The roller burnishing apparatus 100 includes a workpiece supporting mechanism 101 comprised of a workpiece supporting table 102 that has a headstock and a tail stock (both of which are not shown) between which the workpiece W is fixed for rotation during roller burnishing operation, a pair of rollers 103 rotatably supported on the workpiece supporting table 102 to rotatably support the workpiece W, a pressure applying mechanism 104 including a tool holder 105 connected to and operated by a pressure source 106 to apply a pressure force to a surface finish tool with the pressure force exhibiting a given distribution pattern along an axial direction of the workpiece, a tool support 107 fixedly retained by the tool holder 105 and rotatably supporting a burnishing roller 108, serving as the surface finish tool, in abutting engagement with a convex portion Wb of the workpiece W resulting from preceding lapping operation, and a drive mechanism 109 operatively connected to the workpiece W to rotatably drive the same during burnishing operation. The burnishing roller 108 has a width Lr substantially equal to a length l of the convex portion Wb (see FIG. 5).

In actual practice, the workpiece supporting table 102 may includes a slidable table, carrying the headstock and the tail stock, of a machining apparatus such as a lath.

In alternative, the roller burnishing apparatus 100 may further include a tool holder 105' connected to the pressure source 106, and a tool support 107' retained by the tool holder 105' and rotatably supporting a burnishing roller 108' coaxially aligned with the burnishing roller 108 to be concurrently operated by the pressure source 106. In further alternative, the varnishing rollers 108, 108' may be formed in a single elongated burnishing roller with an axial length substantially equal to a length of a target shaped periphery (pin portion) of the workpiece W except for the fillet portions Wf. In this alternative, the elongated burnishing roller is held out of abutting engagement with a mid-concave area Wa of the target shaped periphery and concurrently brought into abutting engagement with both the convex areas Wb, Wb of the target shaped periphery, enabling roller burnishing to be performed on both the convex portions Wb, Wb at one time. The use of any one of two structures mentioned above enables the convex portion Wb of the target shaped periphery to be burnish finished, preventing the above-described sags from protruding to the fillet portion Wf.

The pressure source 106 may include a structure similar to the pressure applying mechanism 10 of the first embodiment shown in FIG. 2 or may be comprised of a fluid cylinder or an electric motor such that the burnishing roller 108 is held in pressured contact with the target shaped periphery of the workpiece W, with the pressure force exhibiting a given distribution pattern along an axial direction of the workpiece W. The drive mechanism 109 may include the same structure as that of the drive mechanism 40 forming the first embodiment shown in FIG. 1 to rotate the workpiece W in a manner as set forth above.

Here, by the term "convex portion" is meant the protruding portion Wb that protrudes in a radial direction from a bottom of a mid-concave portion Wa as a result of preceding lapping operation carried on the workpiece W. By the terms "sharp edges " are meant the sharp projections $T_1$ formed in zigzags in terms of the surface-roughness sectional curve as shown in FIG. 6.

In operation, the crankshaft W having the target shaped periphery, preliminarily lapped in a profile with the mid-concave portion Wa and the convex portions Wb, Wb, is set between the headstock and the tail stock (not shown) on the workpiece support table 103, such that the target shaped periphery of the crankshaft W rests on the pair of rollers 103, 103. Then, the pressure source 106 is operated to press the burnishing roller 108 against the surface portion (pin portion) of the crankshaft W, with the pressure force exhibiting the given distribution pattern depending upon the axial direction of the workpece W. Here, the burnishing roller 108 is held in pressured contact with the convex portion Wb of the workpiece W so as to allow the axial direction of the burnishing roller 108 to lie in parallel to the axial direction of the workpiece W. During operation of the pressure source 106, the workpiece W is rotated with the drive mechanism 109 under such a condition. Thus, the sharp edges of the convex portion Wb of the target shaped periphery are crushed and flattened, resulting in an increase in a strength of the target shaped periphery. Accordingly, there is no need for preparing a crankshaft having an undesirably increased diameter or no need for manufacturing a crankshaft in a large size, resulting in miniaturization and light weight in structure of the workpiece.

Since such burnishing operation is not performed over an entire area of the target shaped periphery of the workpiece but merely on the convex portion Wb, a margin for roller burnishing to be performed can be remarkably minimized, realizing burnishing operation in a short period of time.

However, if an excessive degree of roller burnishing is carried out to excessively minimize the surface roughness on the target shaped periphery, a probability occurs where insufficient oil sump is provided in the flattened area of the convex portion Wb and, therefore, it is preferable for the target portion to be roller burnished to an extent where only the sharp edges $T_1$ (see FIG. 7) is crushed so as to remain as the desired oil-sump.

Example of Third Embodiment

Test was conducted to burnish a crankshaft using a commercially available hydraulic type ball-point tool (manufactured by ECOROLL Company) as a roller burnish tool. The crankshaft was set between the headstock and the tail stock of a lathe and rotated. First, the crankshaft was grounded in a surface quality of a value less than 0.63 μmRa. Then, the crankshaft was lapped in lapping step (for coarse lapping) of a first stage using a lapping film with an abrasive surface covered with abrasive grains of approximately 30 μm, resulting in the surface quality of a value less than 0.2 μmRa. And, lapping step (for finish lapping) in the second stage was carried out using a lapping film with an abrasive surface covered with abrasive grains of approximately 20 μm, resulting in the surface quality of a value less than 0.1 μmRa.

After finish lapping, roller burnishing was conducted on the resulting crankshaft, but it was hard to flatten the sharp edges of the crankshaft resulting from lapping operation. Because, it was considered that the presence of an arithmetic average roughness on the order of the value less than 0.1 μmRa meant the surface roughness lying at a value of approximately 1 μm and the crankshaft had a fairly good surface roughness with the presence of the small sharp edges, in terms of the surface-roughness sectional curve, which deemed to be densely distributed.

Therefore, lapping operation in the second stage was abolished, and burnishing operation was conducted on the crankshaft resulting from lapping operation in the first stage. Upon such burnishing operation, the sharp edges $T_1$ (see FIG. 7), in terms of the surface-roughness sectional curve, could be flattened, resulting in an excellent result with formation of the oil sump-function.

With the roller burnishing apparatus of the presently filed embodiment, since the workpiece is first subjected to lapping operation to allow the target shaped periphery to be formed in the mid-concave profile and the convex portions on both sides of the mid-concave profile of the workpiece are roller burnished, with the pressure force exhibiting the given distribution pattern depending upon the axial direction of the workpiece to form the flattened surfaces, even in the occurrence of a pressure force applied to the flattened surfaces, on both ends of the pin portion of the workpiece to which an associated component part is held in abutting engagement, an initial quality of surface finish resulting from roller burnishing can be maintained for an extended period of time with a resultant increase in a durability with no occurrence of so-called initial wear.

Further, by roller burnishing the convex portions on both sides of the mid-concave profile of the workpiece, the pin portion of the workpiece can be surface finished in a favorable straightness. Also, due to the presence of compression residual stress applied to the flattened convex portions, on both sides of the mid-concave profile, to which the associated component part is held in abutting engagement, the workpiece has an improved strength, enabling miniaturization and light weight in structure without causing the workpiece to be undesirably formed in a large diameter or in a large size.

Furthermore, since the sharp edges, in terms of the surface-roughness sectional curve, of the pin portion of the workpiece are roller burnished, compression residual stress can be applied to the flattened surfaces in given limited regions in intended depths and, as a result, the workpiece is able to have an improved strength, thereby realizing miniaturization and light weight in structure. Also, the both ends of the pin portion of the workpiece, to which the associated component part is held in abutting engagement, can be formed with oil sumps, resulting in an increase in a durability. Especially, since the roller burnishing is performed on only the convex portions of the pin portion of the workpiece, the roller burnishing can be successfully achieved even without being applied with an extremely high pressure force, and it becomes possible to preclude the sags from occurring on the burnished areas, resulting in surface finish in a favorable straightness.

If a crankshaft having a journal portion or a pin portion with both ends thereof formed with fillet portions is used as the workpiece and the journal portion or the pin portion are lapped followed by roller burnishing, the above described advantages are further enhanced. That is, when mounting a bearing or a connecting rod to the journal portion or the pin portion of the crankshaft as the associated component parts, not only the avoidance of sags described above, increased strength, miniaturization, light weight in structure and the superiority in surface finishing can be further enhanced, but also the concave shaped central portion of the journal portion or the pin portion may serve as an oil sump from which oil is supplied to both the end portions of the finished product with a remarkable improvement in a lubricating property and a durability.

Fourth Embodiment

Figure 24:
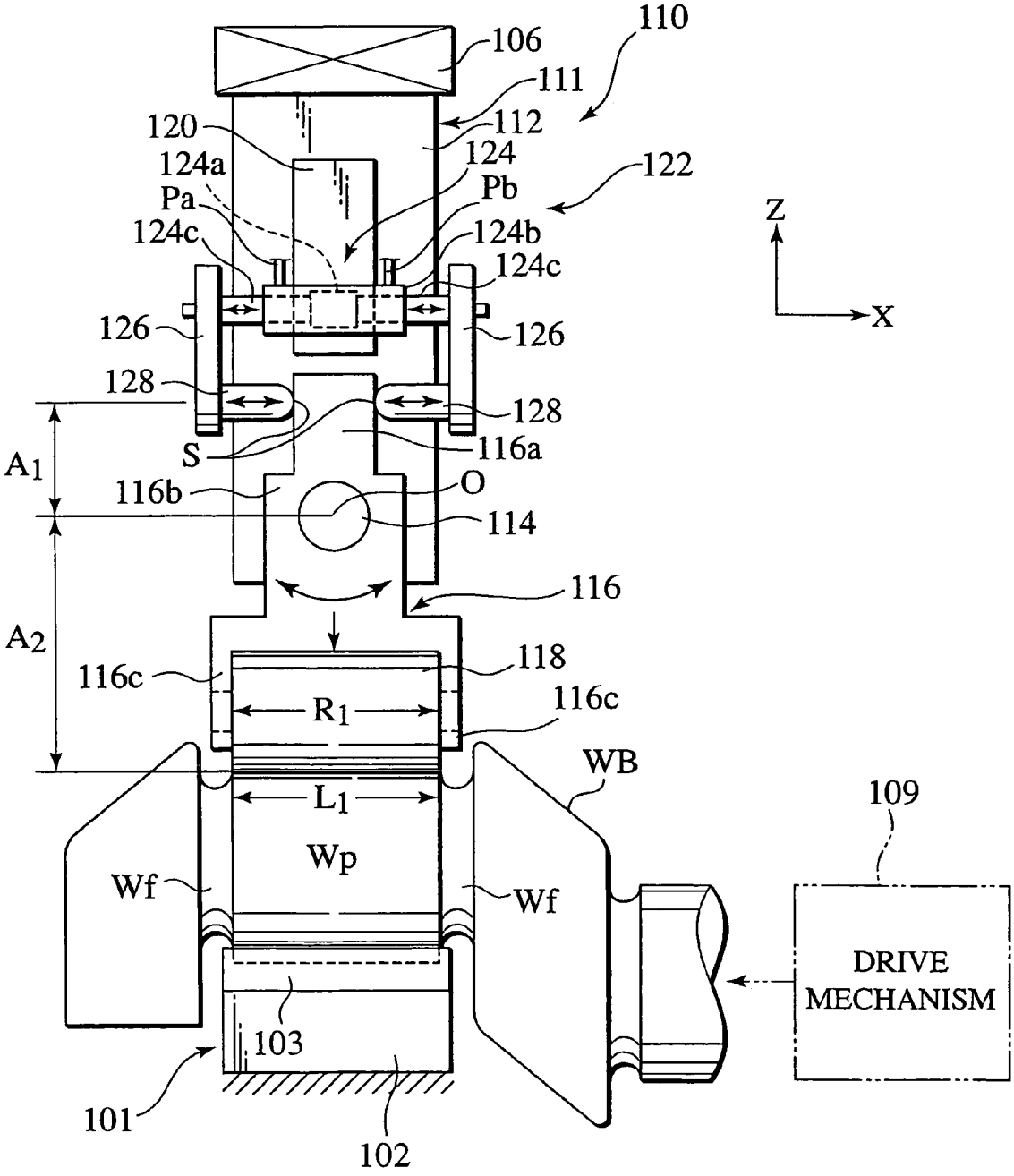
FIG. 24 is a schematic structural view of a surface finishing apparatus, in the form of a roller burnishing apparatus, of a fourth embodiment according to the present invention.
Figure 25:
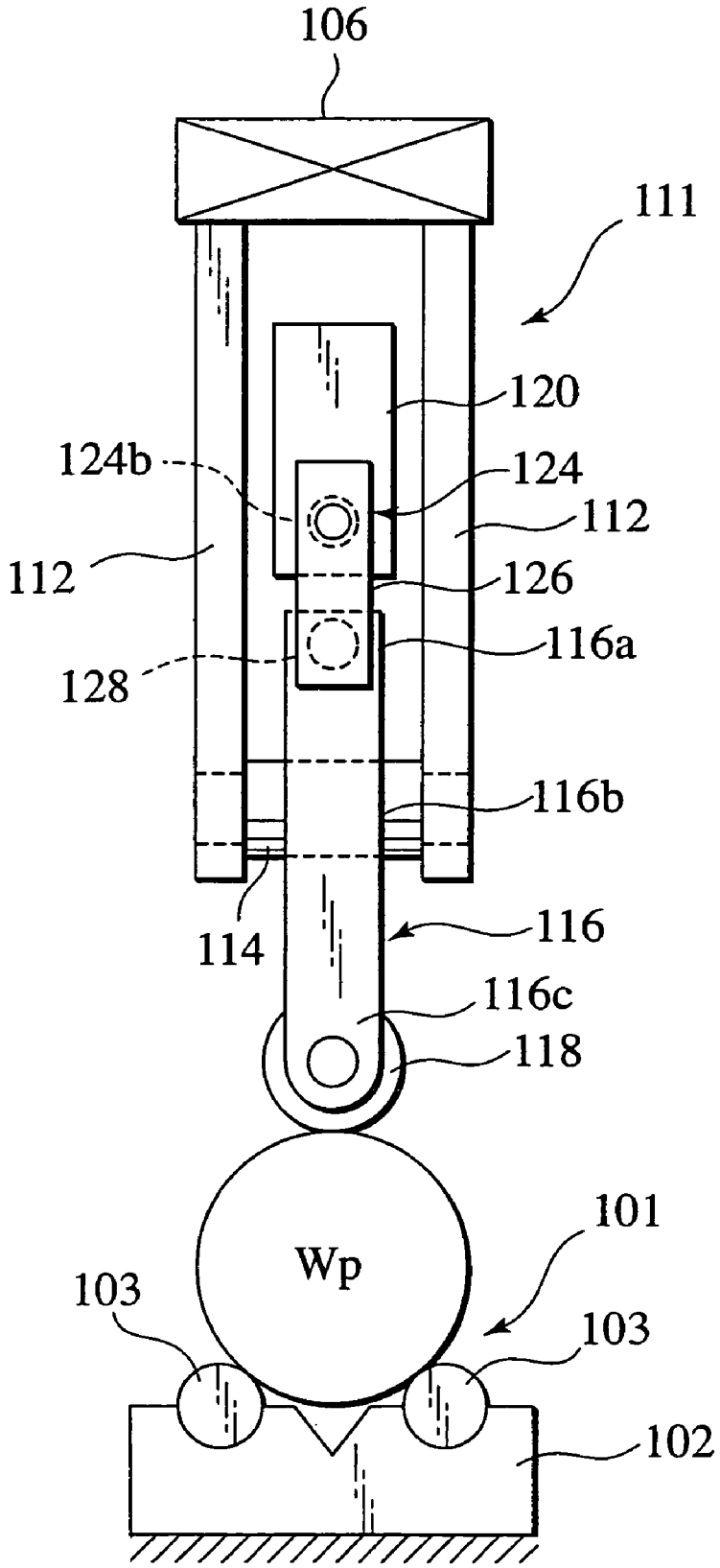
FIG. 25 is a side view of the surface finishing apparatus shown in FIG. 24, in the fourth embodiment.

FIG. 24 is a schematic view of a surface finishing apparatus of a fourth embodiment of the present invention, and FIG. 25 is a side view of the surface finishing apparatus shown in FIG. 24.

The surface finishing apparatus of the fourth embodiment differs from the third embodiment in that a workpiece WB to be roller burnished includes a target shaped periphery (of a pin portion or a journal portion) Wp formed in a cylindrical outer configuration as a result of preliminary operation such as preliminary machining, heat treatment and grounding, to which an associated component part, such as a connecting rod or a bearing, is mounted and in that a surface finish tool in the form of a burnishing roller is held pressured contact with the target shaped periphery Wp of the workpiece WB in a given pressure distribution pattern along an axial direction of the workpiece WB so as to roller burnish the target cylindrical profile of the workpiece WB in surface finish with a mid-convex profile wherein a central area of the target shaped periphery is larger in diameter than both terminal areas of the target shaped periphery. The same component parts as those of the third embodiment bear like reference numerals to simplify or omit description.

Referring now to FIGS. 24 and 25, there is shown a surface finishing apparatus 110 of the fourth embodiment in the form of a roller burnishing apparatus. The roller burnishing apparatus 110 includes, in addition to workpiece supporting mechanism 101 comprised of the workpiece support table 102 having the headstock and the tail stock (both of which are not shown), the pair of rollers 103 operatively located on the workpiece support table 102, and the pressure source 106, and a pressure applying mechanism 111 for applying a pressure force to a surface finish tool, with the pressure force exhibiting a given distribution pattern depending upon an axial direction of the workpiece. The pressure applying mechanism 111 includes a pair of presser members 112 vertically extending from the pressure source 106 toward the workpiece WB and having lower ends which support a pivot shaft 114 that extends perpendicular to an axial direction of the workpiece WB, a tool holder 116 having an upper portion 116*a*, a middle portion 116*b* pivotally supported by the pivot shaft 114 and lower bracket portions 116*c*, 116*c* by which a burnishing roller 118 is rotatably supported in abutting contact with a target shaped periphery Wp (pin portion) of the workpiece WB, a support bracket 120 having one end connected to the presser members 112, 112. The pressure applying mechanism 111 further includes a rocking mechanism 122 that is supported by the support bracket 120 and operatively connected to the upper portion 116*a* of the tool holder 116 and compels the tool holder 116 to rock about a center of the pivot shaft 114 to cause the burnishing roller 118 to be brought into pressured contact with the target shaped periphery Wp of the workpiece WB in a given pressure distribution pattern.

The burnishing roller 118 includes a normal roller having an outer cylindrical shape. The burnishing roller 118 preferably has an axial length $R_1$ slightly larger than an axial length $L_1$ of the target shaped periphery Wp (pin portion) such that both edges of the burnishing roller 118 slightly protrude into fillet portions Wf, Wf formed adjacent the target shaped periphery Wp in the lateral direction. In particular, the axial length $R_1$ of the burnishing roller 118 is sized to be slightly larger than the axial length $L_1$ by an extent that causes no interference with a balancer (not shown) that would move closer to the pin portion Wp of the crankshaft during the maximum inclination of the burnishing roller 118.

The rocking mechanism 122 is comprised of a rocking source 124 fixedly supported by the support bracket 120 and including a piston 124*a* slidably disposed in a cylinder 124*b* and a piston rod 124*c* having a central portion connected to the piston 124, a pair of support members 126, 126 whose upper ends connected to distal ends of the piston rod 124*c* to be laterally movable depending on the position of the piston 124*a*, and pinch members 128, 128 fixedly secured to lower ends of the support members 126, 126, respectively, in abutting engagement with the upper end 116*a* of the tool holder 116 at contact points S, S to translate lateral movements of the support members 126 into rocking movement of the tool holder 116.

In the presently filed embodiment, the rocking source 124 may be preferably of the type that is able to control a rocking angle θ of the tool holder 116 and, to this end, a piston/cylinder mechanism of fluid actuation type is used as the rocking source 124. When controlling the rocking angle θ, a longitudinal length of the cylinder 124*b* is set to a given length to enable stroke of the piston 124*a* to be restricted.

The piston/cylinder mechanism forming the rocking source 124 has both ends connected to conduits Pa, Pb through which fluid under pressure is selectively and cyclically supplied to both sides of the cylinder 124*b* to cause the piston 124*a* to move to both of left and right positions to allow the support members 126, 126 to move in opposing directions through the piston rods 124*c*, 124*c*, respectively, whereby the pinch members 128, 128 rock the tool holder 116 at the angle θ about the center of the pivot shaft 114 through the head 116*a* of the tool holder 116 for thereby causing the burnishing roller 118 to be cyclically brought into contact with the pin portion Wp of the workpiece W at an inclined angle θ to roller burnish the pin portion Wp in surface finish with the mid-convex profile in a manner as described below in detail.

In actual practice, the rocking angle θ at which the tool holder 116 is caused to rock about the center of the pivot shaft 114 is selected such that though depending on a ratio ($A_1/A_2$) between a distance $A_1$, between the contact position S between the pinch member 128 ad the head 116*a* of the tool holder 116 and the center O of the pivot shaft 114, and a distance $A_2$ between the center O of the pivot shaft 114 and a lower end of the burnishing roller 118, it is suffice for such a dimensional ratio to lie at a value ranging from 1 to 2 and for the rocking angle to lie at a value ranging from 0 to 1 degree. Thus, a stroke of the piston 124*a* may be determined to fall in an extremely small value.

In operation, a pin portion Wp of a crankshaft WB for use in an automobile is machined and subjected to heat treatment and, then, is grounded to be finished into a straight cylindrical shape between filet portions Wf, Wf. This crankshaft is mounted between the headstock and tail stock (not shown) and set in place with the pin portion Wp being held in abutting contact with the pair of rollers 103, 103.

And, the pressure source 106 is operated to allow the burnishing roller 118 to be brought into pressure engagement with the pin portion Wp against the pair rollers 103, 103. Under such a condition, the drive mechanism 109 is operated to rotate the crankshaft WB and, then, the rocking mechanism 122 is operated to cause the burnishing roller 118 to rock through the tool holder 116 to roller burnish the pin portion Wp.

More particularly, with fluid under pressure being supplied to the conduit Pb of the rocking source 124, the piston 124*a* of the rocking source 124 moves leftward in the cylinder 124*b* to cause the support member 126 and the pinch member 128 associated therewith to move leftward through the piston rods 124*c*, 124*c*, thereby causing the upper end 116*a* of the tool holder 116 to rock leftward about the center O of the pivot shaft 114. Since the stroke of the piston 124*a* is restricted by the cylinder 124*b*, the rocking angle θ is restricted to a value of approximately 0 to 1 degree. As a result, the burnishing roller 118 supported by the lower bracket portions 116*c*, 116*c* of the tool holder 116 to fall in a rocked condition in a right direction.

Figure 26:
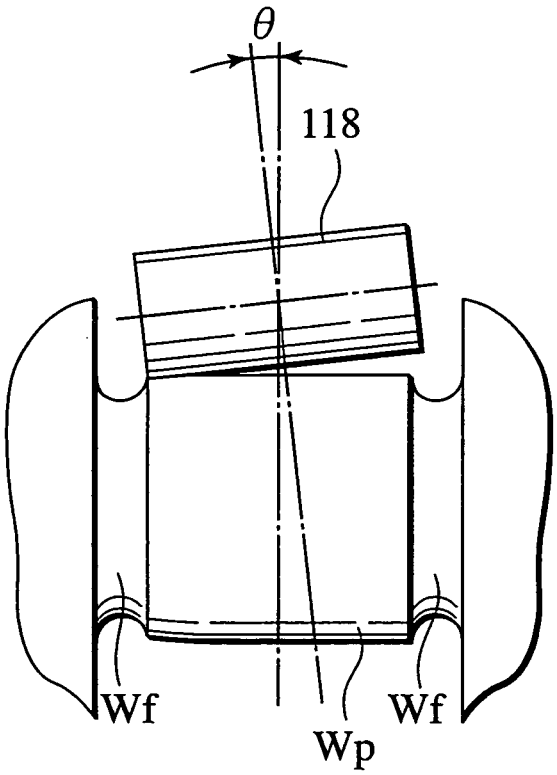
FIG. 26 is a schematic view illustrating an inclined status of a burnishing roller with respect to a workpiece, in the fourth embodiment.

Accordingly, under such a condition, if the pressure source 106 is operated while causing the pin portion Wp to be rotated by the drive mechanism 109, the burnishing roller 118 is brought into pressured contact with the pin portion Wp at a slightly inclined angle as shown in FIG. 26, thereby roller burnishing the pin portion Wp so as to cause a left shoulder portion of the pin portion Wp to be collapsed in a deformed shape.

In the meanwhile, with fluid under pressure being supplied to the conduit Pa of the rocking source 124, the piston 124*a* of the rocking source 124 moves rightward in the cylinder 124*b* to cause the support member 126 and the pinch member 128 associated therewith to move rightward through the piston rods 124*c*, 124*c*, thereby causing the upper end 116*a* of the tool holder 116 to rock rightward about the center O of the pivot shaft 114. As a result, the burnishing roller 118 rock leftward about the center of the pivot shaft 118 and comes to a halt.

Figure 27:
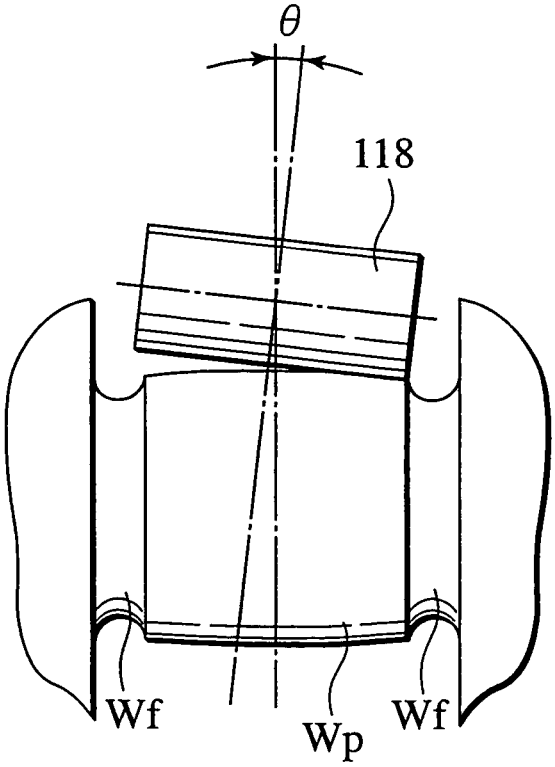
FIG. 27 is a schematic view illustrating another inclined status of the burnishing roller with respect to the workpiece, in the fourth embodiment.

Accordingly, under such a condition, if the pressure source 106 is operated while causing the pin portion Wp to be rotated by the drive mechanism 109, the burnishing roller 118 is brought into pressured contact with the pin portion Wp at a slightly inclined angle as shown in FIG. 27, thereby roller burnishing the pin portion Wp so as to cause a right shoulder portion of the pin portion Wp to be collapsed in a deformed shape.

Thus, when burnishing the left and right shoulder portions of the pin portion Wp using the burnishing roller 118 while rocking the burnishing roller 118, even in the presence of the burnishing roller 118 having the outer cylindrical shape extending straight, the outer shape of the burnishing roller 118 under an inclined state is transferred to the pin portion Wp and longitudinal end portions of the pin portion Wp are collapsed at a greater rate than a central portion of the pin portion Wp.

Figure 29:
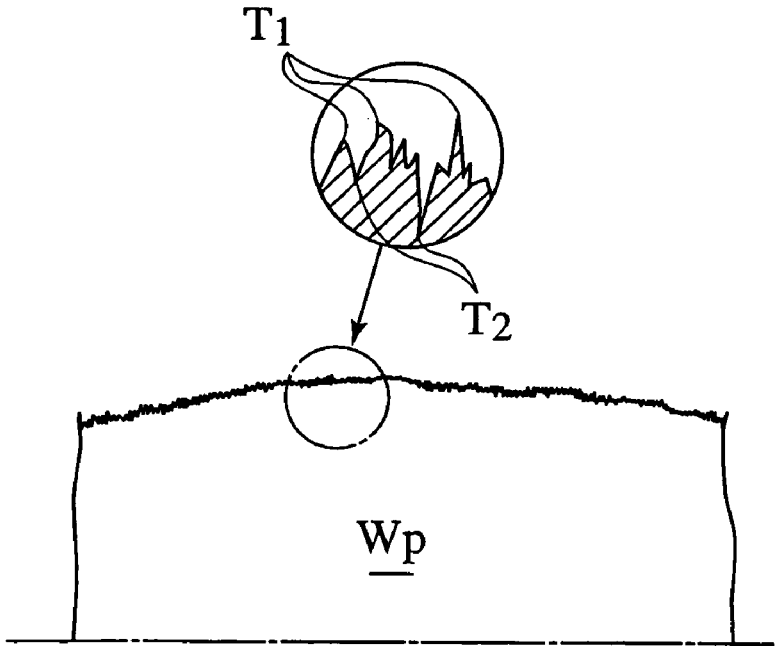
FIG. 29 is a schematic view illustrating a surface roughness of the pin portion of the workpiece resulting from roller burnishing operation, in the fourth embodiment.

As a result, an outer peripheral profile of the pin portion Wp is entirely shaped in a centrally ridged configuration, that is, a drum shape. Further, as shown in FIG. 29, during roller burnishing operation of the pin portion Wp, sharp edges $T_1$ of the surface is collapsed and valley portions $T_2$ are berried to some extent. This results in improvement in a nature in surface and a profile in a product to provide a smoothed surface nature in which an oil sump is formed, thereby providing an improved lubricating property.

Especially, upon formation of the pin portion with the centrally ridged profile, when the pin portion Wp is mated with an associated component part in sliding contact, since the pin portion Wp comes to be brought into contact with the associated component part at one contact point in the central area of the pin portion Wp, the pin portion Wp and the associate component part comes to mate with one another in a favorably balanced condition without causing any deviated loading, enabling deviated wear from occurring with a decrease in change of contact surface area for thereby increasing stability in operation for long-term use and a durability.

Further, since formation of the centrally ridged profile on the pin portion Wp enables compression residual stress to be applied to a contact area of the associated component part, with which the pin portion Wp mates, without suffering from any issue of a drop in a circularity due to the sags, a strength of a whole of the pin portion Wp is improved, enabling miniaturization and light weight in structure to be realized with no need for the crankshaft to be undesirably formed in a large diameter or to be sized in a large scale. In addition, the presence of the piston/cylinder mechanism forming the compact rocking source 124 to cause the burnishing roller 118 to be rocked enables the workpiece with the centrally ridged profile to be simply formed even in a limited narrow space, providing a capability of easily achieving burnishing operation for a short period of time followed by reduction in costs.

Furthermore, since the presence of the pin portion Wp with the centrally ridged profile allow the pin portion Wp and the associated component part to be brought into engagement a restricted contact area while enabling a load to be applied to a center of the pin portion Wp in a longitudinal direction thereof, the pin portion Wp is subjected to a stable loading condition at all times, resulting in reduction in wear.

Example of Fourth Embodiment

Figure 28:
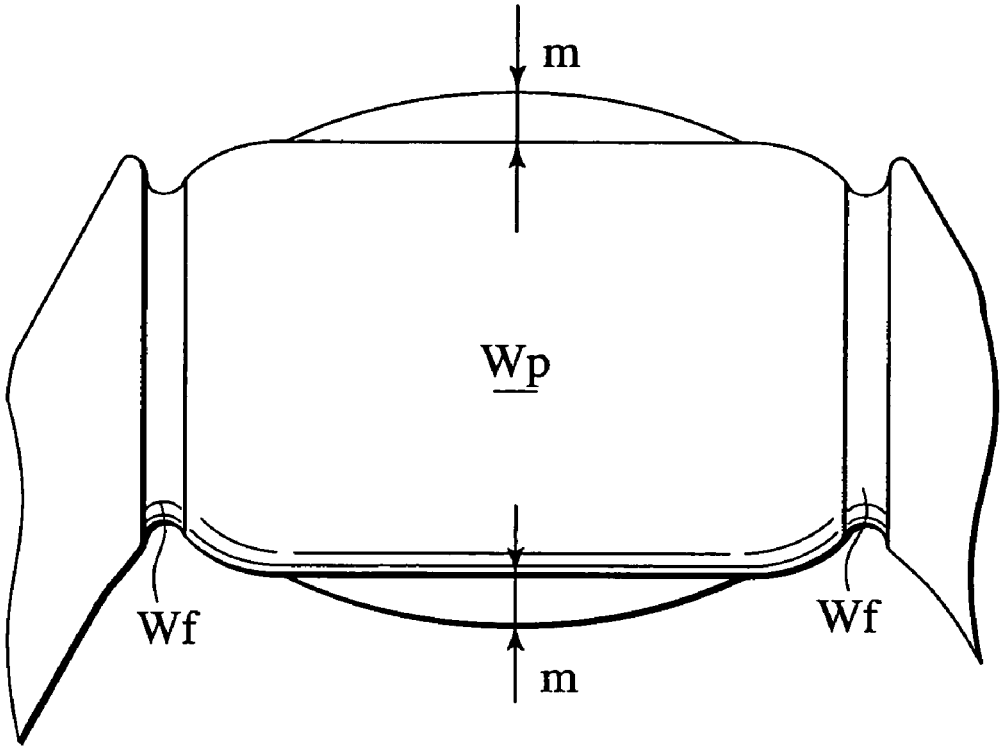
FIG. 28 is a schematic view illustrating a surface profile of a pin portion of the workpiece resulting from roller burnishing operation, in the fourth embodiment.

First, a crankshaft was grounded in a surface quality of a value less than 0.63 μmRa and, then, the crankshaft was set between the headstock and the tail stock of a lathe. Next, roller burnishing was carried over the resulting pin portion of the crankshaft using a commercially available hydraulic type ball point tool (made by ECOROLL Company). Roller burnishing was completed at a timing at which a height m shown in FIG. 28 reached a value of 2 to 8 μm. Also, the sharp edges $T_1$ in terms of the surface-roughness sectional curve shown in FIG. 29 was flattened in success.

A connecting rod was mounted to the resulting crankshaft subsequent to roller burnishing, and an assembly of the crankshaft and the connecting rod was incorporated into an engine whereupon the engine was operated. Upon conducting tests, it was proved that the resulting crankshaft was found to be favorable and to be free from stress concentration and an issue of a lubricating property.

With the surface finishing apparatus 110 of the presently filed embodiment, since the target shaped periphery of the workpiece is burnished by rocking the cylindrical burnishing roller, that is placed on the target shaped portion along the axis thereof to be pressed, with the pressure force exhibiting the given distribution pattern depending upon the axial direction of the workpiece, the longitudinal terminal portions of the target shaped portion are roller burnished at a greater degree than that roller burnished at the central portion. This results in an improved surface roughness, an increased fatigue strength of dynamically loaded components, an improved surface nature, an improved surface profile, a saved production time and improved fatigue resistance. The target shaped periphery of the workpiece can be formed in the centrally ridged profile with the central area being larger in diameter than both the end portions of the target shaped periphery. Especially, the use of the burnishing roller having the straight cylindrical configuration provides a lower cost in manufacturing than that required when using a high cost burnishing roller and results in significant economic benefits at rather low investment.

Further, in the presence of the workpiece with the target shaped periphery burnished in the centrally ridged profile, the target shaped periphery of the workpiece mates with the associated component element in contact at one central point to allow the relevant component parts to be held in engagement with one another in a favorably balanced condition with no occurrence of deviated loading. This results in no deviated wear and reduction in change in the contact area, enabling an operating stability to be enhanced for long-term use while increasing a durability. Also, since the target shaped portion of the workpiece becomes free from the burrs set forth above and compression residual stress can be applied to the area with which the associated component part is held in engagement, the product has an increased strength.

Additionally, since burnishing operation can be achieved through mere rocking movement of the burnishing roller, it is easy to perform burnishing operation and surface finishing can be carried out in a short time period, providing an advantage in cost in view of work.

Moreover, due to the provision of the tool holder having the central portion pivotally supported on the pivot shaft and the end portion adapted to be rocked by the rocking source at a given rocking angle while enabling the pressure applying mechanism to apply a pressure force to the burnishing roller, the burnishing roller can be subjected to rocking movement and pressured against the target shaped portion of the workpiece in a smooth and easy fashion.

Furthermore, due to an ability of the rocking source to allow the tool holder supporting the burnishing roller to be rocked about the center of the pivot shaft and an ability to adjust the inclined condition of the burnishing roller with respect to the workpiece, the burnishing roller can be inclined with respect to the axis of the workpiece even within a slight space for thereby providing a remarkably improved workability. Also, since the burnishing roller can be brought into pressured contact with the workpiece by the action of the pressure applying mechanism while permitting the burnishing roller to be inclined by the rocking source, the inclined condition and the pressure applying condition for the workpiece can be independently adjusted, enabling the workpiece to be burnished in a profile with a desired, centrally ridged portion in a precise and an extremely easy fashion.

In addition, the provision of the rocking source comprised of the piston/cylinder mechanism enables the tool holder to be rocked in an extremely compact space.

Moreover, upon selection of the workpiece having the journal portion or the pin portion each of which has both ends formed with fillet portions, the spaces of the fillet portions can be utilized for rocking the burnishing roller, providing a further ease of carrying out burnishing operation.

The entire content of a Patent Application No. TOKUGAN 2003-036704 with a filing date of Feb. 14, 2003 in Japan, a Patent Application No. TOKUGAN 2003-034073 with a filing date of Feb. 12, 2003 in Japan, a Patent Application No. TOKUGAN 2003-066592 with a filing date of Mar. 12, 2003 in Japan and a Patent Application No. TOKUGAN 2003-036700 with a filing date of Feb. 14, 2003 in Japan, are respectively hereby incorporated by reference.

Although the invention has been described above by reference to certain embodiments of the invention, the invention is not limited to the embodiments described above. Modifications and variations of the embodiments described above will occur to those skilled in the art, in light of the teachings. The scope of the invention is defined with reference to the following claims.

What is claimed is:

1. A surface finishing apparatus for surface finishing a target shaped periphery of a workpiece into a mid-concave profile, comprising:

a workpiece supporting mechanism for supporting the workpiece having the target shaped periphery to be surface finished;

a surface finish tool including a lapping film adapted to be in abutting contact with the target shaped periphery of the workpiece;

a pressure applying mechanism including a plurality of shoes disposed on a rear side of the lapping film to be operative to apply a pressure force to the lapping film to cause the lapping film to be held in pressured contact with the target shaped periphery of the workpiece;

a drive mechanism for rotating the workpiece about an axial direction during operation of the pressure applying mechanism to allow the surface finish tool to surface finish the target shaped periphery of the workpiece into the mid-concave profile, while exhibiting a distribution pattern of the pressure force of the surface finish tool; and an oscillating mechanism for oscillating at least one of the workpiece and the lapping film in the axial direction of the workpiece in a given oscillation stroke such that a working position of the lapping film is cyclically shifted in the given oscillation stroke with respect to the target shaped periphery of the workpiece to allow the workpiece to be surface finished in the mid-concave profile, wherein the pressure applying mechanism is adapted to operatively hold the plurality of shoes on the rear side of the lapping film in different contact areas in a partially overlapping relationship at a central region of the target shaped periphery of the workpiece and in non-overlapping relationship in both terminal regions of the target shaped periphery such that the plurality of shoes are held in opposing offset positions with offset displacement of each of the plurality of shoes set to be less than the given oscillation stroke provided by the oscillating mechanism to allow the central region of the target shaped periphery to be lapped at a greater rate than those at which other regions of the target shaped periphery are lapped, resulting in the target shaped periphery having a surface profile formed in the mid-concave profile having a depth equal to or greater than 5 μm and equal to or less than 20 μm.

2. The surface finishing apparatus according to claim 1, wherein:

the lapping film includes a thin-walled base member having an entire surface provided with abrasive material with an abrasive surface of the thin-walled base member; and the plurality of shoes allows the abrasive surface of the lapping film to be held in contact with the target shaped periphery to be lapped.

3. The surface finishing apparatus according to claim 2, wherein the pressure applying mechanism includes a tool holder that operatively holds the plurality of shoes on the rear side of the lapping film.

4. The surface finishing apparatus according to claim 3, wherein the tool holder further includes a shoe pressure force adjusting unit operative to adjust a shoe pressure force to be applied to the plurality of shoes.

5. The surface finishing apparatus according to claim 4, wherein:

a tool shifting mechanism includes the oscillating mechanism oscillating at least one of the workpiece and the lapping film with respect to one another in the axial direction of the workpiece; the apparatus further comprising:

a detecting unit detecting a relative oscillating position of the workpiece with respect to the lapping film during oscillating movement performed by the oscillating mechanism to be indicative of a current relative oscillating movement of the workpiece; and a controller variably controlling the pressure force adjusting unit to vary the shoe pressure force in response to the current relative oscillating movement of the workpiece such that the lapping film is held in contact with the target shaped periphery of the workpiece to lap the target shaped periphery into a given geometrical profile.

6. The surface finishing apparatus according to claim 5, wherein the controller controls operation of the pressure force adjusting unit such that the pressure force occurring when the oscillating position of the workpiece assumes both terminal portions of the oscillating stroke of the workpiece during the oscillating movement thereof becomes greater than that occurring when the oscillating position of the workpiece assumes a central position on the oscillating stroke of the workpiece during the oscillating movement thereof, whereby the given geometrical profile is formed into at least one of a flat shape and a mid-convex shape.

7. The surface finishing apparatus according to claim 6, wherein the controller controls the operation of the pressure force adjusting unit such that a change rate, between the pressure force occurring when the oscillating position of the workpiece assumes the both terminal portions of the oscillating stroke of the workpiece during the oscillating movement thereof and the pressure force occurring when the oscillating position of the workpiece assumes the central position on the oscillating stroke of the workpiece during the oscillating movement thereof, required for forming the geometrical profile into the mid-convex shape, is set to be greater than that required for forming the geometrical profile into the flat shape.

8. The surface finishing apparatus according to claim 5, wherein the controller controls operation of the pressure force adjusting unit such that the pressure force occurring when the oscillating position of the workpiece assumes both terminal portions of the oscillating stroke of the workpiece during the oscillating movement thereof becomes smaller than that occurring when the oscillating position of the workpiece assumes a central position on the oscillating stroke of the workpiece during the oscillating movement thereof, whereby the given geometrical profile is formed into a mid-concave shape.

9. The surface finishing apparatus according to claim 2, wherein the workpiece includes a crankshaft having a journal portion or a pin portion each having the target shaped periphery, on both ends of which fillet portions are formed.

10. The surface finishing apparatus according to claim 2, wherein the lapping film includes the thin-walled base member, the thin-walled base member being non-extensible and deformable.

11. The surface finishing apparatus according to claim 2, wherein the pressure applying mechanism includes first and second presser arms pivotally supported to be moved in an open position and a closing position, first and second shoe cases slidably carried by the first and second presser arms and disposed on the rear side of the lapping film held in contact with the target shaped periphery of the workpiece, and first and second pressure force adjusting units cooperating with the first and second shoe cases, respectively, to apply adjustable shoe pressure forces to respective first and second shoes.

12. The surface finishing apparatus according to claim 11, wherein the first and second pressure force adjusting units includes first and second lift adjustment elements operatively connected to the first and second shoe cases through first and second presser rods, respectively, and first and second actuators connected to the first and second lift adjustment elements, respectively, to vary angular working positions of the first and second lift adjustment elements with respect to the first and second presser rods, respectively, for thereby varying the shoe pressure forces to be applied to the first and second shoes, respectively.

13. The surface finishing apparatus according to claim 1, wherein the plurality of shoes include an even number of shoes with a same width and the even number of shoes are alternately offset at different sides with respect to a center of the target shaped periphery to be lapped.

14. The surface finishing apparatus according to claim 1, wherein an amount of offset displacement between the plurality of shoes falls in a value ranging from 3 to 12% of the given width of the target shaped periphery to be lapped.

15. The surface finishing apparatus according to claim 1, wherein:

the workpiece has the target shaped periphery with a geometrical profile, lapped in a mid-concave shape;

a tool holder is connected to the pressure applying mechanism and includes a tool support; and the surface finish tool includes a burnishing roller supported by the tool support in pressured contact with the target shaped periphery of the workpiece for thereby burnishing terminal convex portions of the target shaped periphery in given surface roughness.

16. The surface finishing apparatus according to claim 15, wherein the burnishing roller is operative to flatten sharp edges on both the terminal convex portions of the target shaped periphery.

17. The surface finishing apparatus according to claim 16, wherein the target shaped periphery of the workpiece includes a journal portion or a pin portion of a crankshaft formed with fillet portions on both ends of the target shaped periphery.

18. A surface finishing apparatus for surface finishing a target shaped periphery of a workpiece into a mid-concave profile, comprising:

workpiece supporting means for supporting the workpiece having the target shaped periphery to be surface finished;

a surface finish tool including a lapping film adapted to be in abutting contact with the target shaped periphery of the workpiece;

pressure applying means for applying a pressure force to the lapping film to cause the lapping film to be held in pressured contact with the target shaped periphery of the workpiece;

rotating means for rotating the workpiece about an axial direction during operation of the pressure applying means to allow the surface finish tool to surface finish the target shaped periphery of the workpiece into the mid-concave profile, while exhibiting a distribution pattern of the pressure force of the surface finish tool; and oscillating means for oscillating at least one of the workpiece and the lapping film in the axial direction of the workpiece in a given oscillation stroke such that a working position of the lapping film is cyclically shifted in the given oscillation stroke with respect to the target shaped periphery of the workpiece to allow the workpiece to be surface finished in the mid-concave profile, wherein the pressure applying means is adapted to operatively apply pressure on a rear side of the lapping film in different contact areas in a partially overlapping relationship at a central region of the target shaped periphery of the workpiece and in non-overlapping relationship in both terminal regions of the target shaped periphery such that the portions of the pressure applying means disposed on the rear side of the lapping film are held in opposing offset positions with offset displacement of each of the portions of the pressure applying means disposed on the rear side of the lapping film set to be less than the given oscillation stroke provided by the oscillating means to allow the central region of the target shaped periphery to be lapped at a greater rate than those at which other regions of the target shaped periphery are lapped, resulting in the target shaped periphery having a surface profile formed in the mid-concave profile having a depth equal to or greater than 5 μm and equal to or less than 20 μm.

19. A method of surface finishing a target shaped periphery of a workpiece into a mid-concave profile, the method comprising:

supporting the workpiece having the target shaped periphery to be surface finished;

holding a surface finish tool including a lapping film in abutting contact with the target shaped periphery of the workpiece;

disposing a plurality of shoes on a rear side of the lapping film to apply a pressure force to the lapping film to cause the lapping film to be held in pressured contact with the target shaped periphery of the workpiece;

rotating the workpiece about an axial direction to allow the surface finish tool to surface finish the target shaped periphery of the workpiece into the mid-concave profile, while exhibiting a distribution pattern of the pressure force of the surface finish tool; and oscillating at least one of the workpiece and the lapping film in the axial direction of the workpiece in a given oscillation stroke such that a working position of the lapping film is cyclically shifted in the given oscillation stroke with respect to the target shaped periphery of the workpiece to allow the workpiece to be surface finished in the mid-concave profile, wherein the plurality of shoes are held on the rear side of the lapping film in different contact areas in a partially overlapping relationship at a central region of the target shaped periphery of the workpiece and in non-overlapping relationship in both terminal regions of the target shaped periphery such that the plurality of shoes are held in opposing offset positions with offset displacement of each of the plurality of shoes set to be less than the given oscillation stroke to allow the central region of the target shaped periphery to be lapped at a greater rate than those at which other regions of the target shaped periphery are lapped, resulting in the target shaped periphery having a surface profile formed in the mid-concave profile having a depth equal to or greater than 5 μm and equal to or less than 20 μm.

* * * * *